US010714029B2

(12) United States Patent
Ikeda et al.

(10) Patent No.: US 10,714,029 B2
(45) Date of Patent: Jul. 14, 2020

(54) DISPLAY DEVICE HAVING A PLURALITY OF SUBPIXEL ELECTRODES ARRANGED IN DIFFERENT DIRECTIONS

(71) Applicant: Japan Display Inc., Tokyo (JP)

(72) Inventors: Kojiro Ikeda, Tokyo (JP); Masaaki Kabe, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/150,915

(22) Filed: Oct. 3, 2018

(65) Prior Publication Data

US 2019/0114976 A1 Apr. 18, 2019

(30) Foreign Application Priority Data

Oct. 12, 2017 (JP) ..... 2017-198762

(51) Int. Cl.
*G09G 3/34* (2006.01)
*G09G 3/20* (2006.01)

(52) U.S. Cl.
CPC ..... *G09G 3/3426* (2013.01); *G09G 3/20* (2013.01); *G09G 3/2003* (2013.01); *G09G 3/2074* (2013.01); *G09G 2320/0242* (2013.01); *G09G 2320/0666* (2013.01)

(58) Field of Classification Search
CPC ..... G09G 3/3426
USPC ..... 345/88
See application file for complete search history.

(56) References Cited

U.S. PATENT DOCUMENTS

2003/0035079 A1 2/2003 Kim et al.
2012/0249404 A1 10/2012 Sakaigawa et al.
2014/0300714 A1* 10/2014 Muller ..... H04N 13/31 348/54
2014/0362320 A1 12/2014 Sato et al.
2016/0070144 A1* 3/2016 Jin ..... G02F 1/133707 349/144
2016/0071883 A1* 3/2016 Jin ..... G02F 1/134336 349/144
2016/0085122 A1 3/2016 Nishihara et al.
(Continued)

FOREIGN PATENT DOCUMENTS

JP 200029072 A 1/2000
JP 2009237414 A 10/2009
JP 201033009 A 2/2010
(Continued)

*Primary Examiner* — Long D Pham
(74) *Attorney, Agent, or Firm* — K&L Gates LLP

(57) ABSTRACT

A display device includes a display unit having a display surface on which pixels are arranged in row and column directions. Each pixel includes subpixels having different colors. Subpixels in the pixels include a first subpixel including an electrode having an opening with a longitudinal direction along a first direction and a second subpixel including an electrode having an opening with a longitudinal direction along a second direction. The first and second directions are different from the row and column directions. Subpixels arranged in a third direction are the first or second subpixels. The number of subpixels constituting one color pattern in a fourth direction is 2α. The number of subpixels in which the first and second subpixels arranged in the fourth direction constitute one cycle is 4α. The third direction is one of the row and column directions, and the fourth direction is the other direction.

15 Claims, 24 Drawing Sheets

(56) References Cited

U.S. PATENT DOCUMENTS

| | | | |
|---|---|---|---|
| 2016/0124278 | A1 | 5/2016 | Ogura et al. |

FOREIGN PATENT DOCUMENTS

| | | | |
|---|---|---|---|
| JP | 201253137 | A | 3/2012 |
| JP | 5992097 | B2 | 8/2016 |
| WO | 2014185122 | A1 | 11/2014 |

* cited by examiner

| PATTERN NO. | ARRANGEMENT EXAMPLE OF PIXELS AND SUBPIXELS |
|---|---|
| 1-1 |   |
| 1-2 |   |

| PATTERN NO. | ARRANGEMENT EXAMPLE OF PIXELS AND SUBPIXELS |
|---|---|
| 2-1 |  |
| 2-2 |  |

| PATTERN NO. | ARRANGEMENT EXAMPLE OF PIXELS AND SUBPIXELS |
|---|---|
| 3 |  |

DISPLAY DEVICE HAVING A PLURALITY OF SUBPIXEL ELECTRODES ARRANGED IN DIFFERENT DIRECTIONS

CROSS-REFERENCE TO RELATED APPLICATIONS

This application claims priority from Japanese Application No. 2017-198762, filed on Oct. 12, 2017, the contents of which are incorporated by reference herein in its entirety.

BACKGROUND

1. Technical Field

The present disclosure relates to a display device.

2. Description of the Related Art

With what is called a single-domain method, in which the orientations in a liquid crystal display device in a transverse electric field mode such as an in-plane switching (IPS) mode are the same for all the subpixels, what is called color shift may be caused, which is where different colors are visually recognized at different viewing angles. It is known that there is a display device that uses what is called a multi-domain method, which is where a plurality of subpixels of various types having different orientations are provided (for example, Japanese Patent Application Laid-open Publication No. 2000-29072 and International Publication WO 2014/185122).

With the conventional multi-domain method, two types of subpixels having different orientations are alternately arranged row by row. Thus, when there is non-uniformity in the color of subpixels in different rows, the proportion of orientations of two types of subpixels is non-uniform among subpixels of individual colors, and hence the color shift is not solved.

For the foregoing reasons, there is a need for a display device capable of reducing or preventing the occurrence of color shift more reliably.

SUMMARY

According to an aspect, a display device includes a display unit having a display surface on which a plurality of pixels are arranged in row and column directions. Each of the pixels includes a plurality of subpixels having different colors. Subpixels included in the pixels include a first subpixel and a second subpixel, the first subpixel including an electrode having an opening with a longitudinal direction along a first direction, the second subpixel including an electrode having an opening with a longitudinal direction along a second direction. The first direction and the second direction are directions along the display surface and are different from the row and column directions. Subpixels arranged in a third direction are the first subpixels or the second subpixels. The number of subpixels constituting one color pattern in a fourth direction is $2\alpha$. The number of subpixels in which the first subpixels and the second subpixels arranged in the fourth direction constitute one cycle is $4\alpha$. The third direction is one of the row and column directions, and the fourth direction is the other direction of the row and column directions. The number of the first subpixels with odd numbers, the number of the first subpixels with even numbers, the number of the second subpixels with odd numbers, and the number of the second subpixels with even numbers when counted from one end side in the fourth direction within the one cycle are equal to one another. $\alpha$ is a natural number.

DETAILED DESCRIPTION

Figure 1:
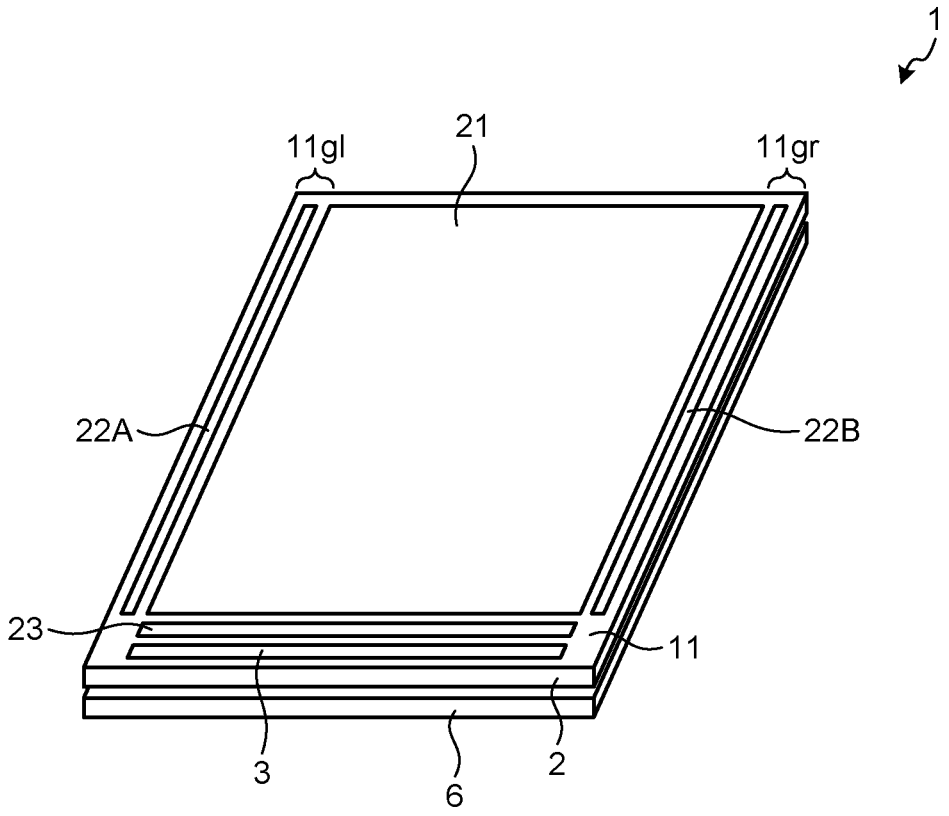
FIG. 1 is an explanatory diagram illustrating an example of a display device according to a first embodiment.

Embodiments of the present invention are described below with reference to the accompanying drawings. What is disclosed herein is merely illustrative, and it should be understood that appropriate modifications that could be easily conceived by a person skilled in the art within the gist of the invention naturally be encompassed in the scope of the present invention. For clearer description in the accompanying drawings, the width, thickness, and shape of each part may be schematically illustrated as compared with actual aspects, but these are merely illustrative and are not intended to limit the interpretation of the present invention. In the specification and the drawings, components similar to those previously described with reference to earlier figures are denoted by the same reference numerals, and detailed descriptions thereof may be omitted as appropriate.

In this disclosure, when an element is described as being "on" another element, the element can be directly on the other element, or there can be one or more elements between the element and the other element.

First Embodiment

Figure 2:
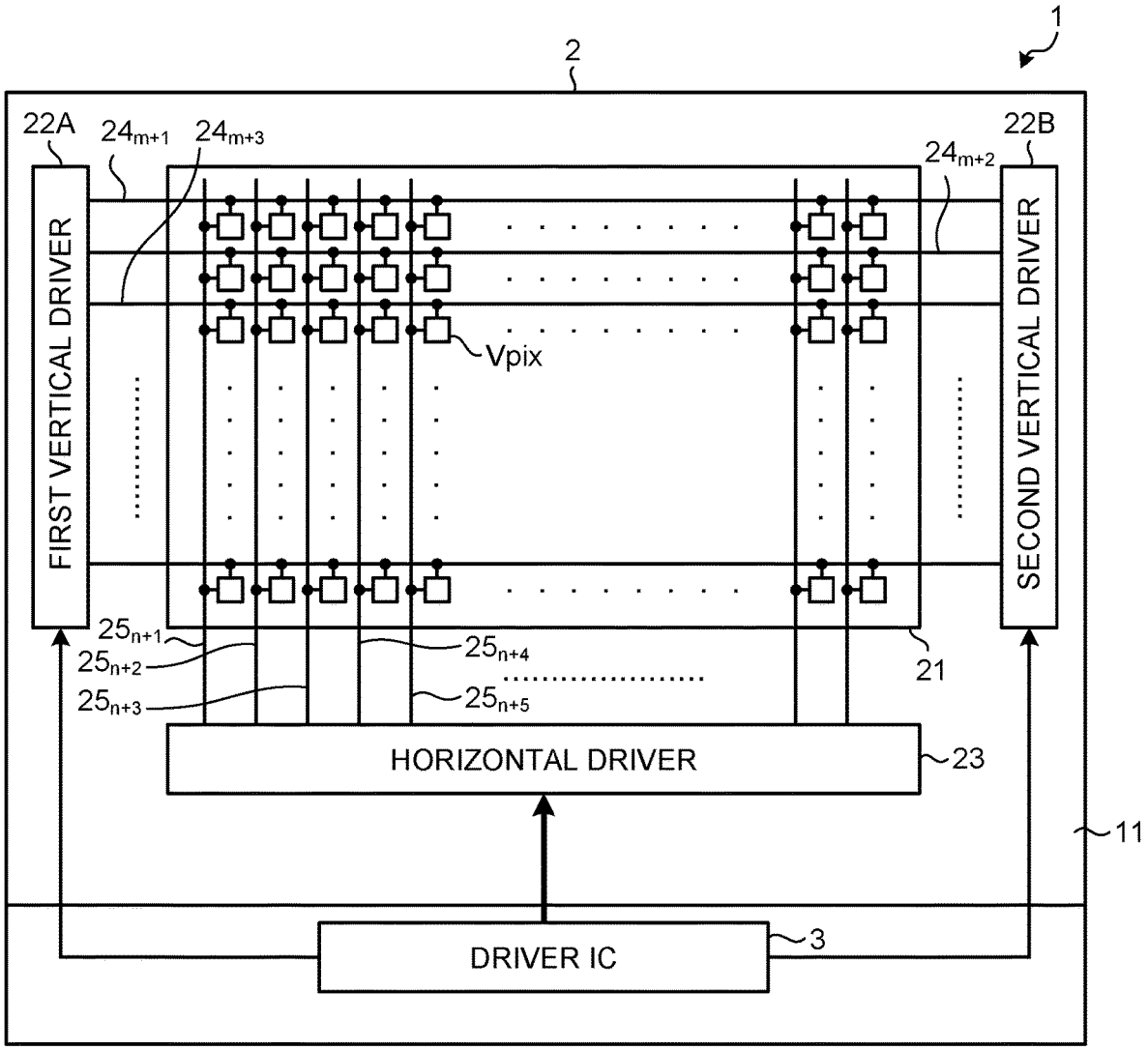
FIG. 2 is a block diagram illustrating a system example of the display device in FIG. 1.

FIG. 1 is an explanatory diagram illustrating an example of a display device 1 according to a first embodiment. FIG. 2 is a block diagram illustrating a system example of the display device 1 in FIG. 1. FIG. 1 is a schematic view, and the illustrated dimensions and shapes are not necessarily the same as the actual ones.

The display device 1 includes a display unit 2, a driver IC 3, and a backlight 6. The display device 1 may be a transmissive or transflective display device, or may be a reflective display device without the backlight 6. Flexible printed circuits (FPC) (not illustrated) transmit an external signal to the driver IC 3 or drive power for driving the driver IC 3 thereto. The display unit 2 includes a translucent insulating substrate, such as a glass substrate 11, a display area 21, a horizontal driver (horizontal drive circuit) 23, and vertical drivers (vertical drive circuits) 22A and 22B. The display area 21 is provided on the surface of the glass substrate 11. In the display area 21, a plurality of pixels Pix (see FIG. 3) are arranged in a matrix (row-column configuration) along row and column directions. The vertical drivers (vertical drive circuits) 22A and 22B are arranged as a first vertical driver 22A and a second vertical driver 22B so as to sandwich the display area 21. The display unit 2 may include only one of the first vertical driver and the second vertical driver. The glass substrate 11 includes a first substrate 50 and a second substrate 52. The first substrate 50 is a substrate on which a plurality of pixel circuits including active elements (for example, transistors) are arranged in a matrix (row-column configuration), and the second substrate 52 is arranged to be opposed to the first substrate 50 with a predetermined gap therebetween. The glass substrate 11 has a liquid crystal layer 54 (see FIG. 4) formed by sealing liquid crystal between the first substrate 50 and the second substrate 52. The horizontal driver (horizontal drive circuit) 23 and the vertical drivers (vertical drive circuits) 22A and 22B are provided on the first substrate 50, and are therefore also called peripheral circuits. The display device 1 is not limited to such a liquid crystal display device, and may be a display device in which self-luminous bodies such as organic light emitting diodes (OLEDs) are turned on. In this case, the backlight 6 in the display device 1 can be omitted because the display area 21 can emit light.

Frame regions 11*gr* and 11*gl* of the display unit 2 are non-display regions provided on the glass substrate 11 and outside the display area 21 in which a plurality of pixels Pix including liquid crystal elements LC (see FIG. 3) are arranged in a matrix (row-column configuration). The vertical drivers 22A and 22B are arranged in the frame regions 11*gr* and 11*gl*.

The backlight 6 is arranged on the rear surface side (surface on a side opposite to a surface on which images are displayed) of the display unit 2. The backlight 6 emits light toward the display unit 2, and causes light to enter the entire surface of the display area 21. The backlight 6 includes, for example, a light source and a light guide plate configured to guide light output from the light source such that the light exits toward the rear surface of the display unit 2.

The display unit 2 includes, on the glass substrate 11, the display area 21, the driver IC 3 serving as an interface (I/F) and a timing generator, the first vertical driver 22A, the second vertical driver 22B, and the horizontal driver 23.

The display area 21 has a matrix structure in which a unit of subpixels Vpix including the liquid crystal layer 54 constituting one pixel for display is arranged in m rows and n columns. As used herein, the row refers to a pixel row having n subpixels Vpix arranged in one direction (third direction). The column refers to a pixel column having m subpixels Vpix arranged in another direction (fourth direction) orthogonal to the direction in which the rows are arranged. The values of m and n are determined depending on the display resolution in the vertical direction and the display resolution in the horizontal direction. In the display area 21, scanning lines $\mathbf{24}_1$, $\mathbf{24}_2$, $\mathbf{24}_3$, . . . $\mathbf{24}_m$ are arranged for corresponding rows and signal lines $\mathbf{25}_1$, $\mathbf{25}_2$, $\mathbf{25}_3$, . . . $\mathbf{25}_n$ are arranged for corresponding columns with respect to the arrangement of the subpixels Vpix in the m rows and the n columns. Hereinafter, in the first embodiment, a scanning line 24 or a scanning line $\mathbf{24}_m$ may denote a representative of the scanning lines $\mathbf{24}_1$, $\mathbf{24}_2$, $\mathbf{24}_3$, . . . $\mathbf{24}_m$, and a signal line 25 or a signal line $\mathbf{25}_n$ may denote a representative of the signal lines $25_1$, $25_2$, $25_3$, . . . $25_n$. In the first embodiment, scanning lines $24_{m+1}$, $24_{m+2}$, $24_{m+3}$, . . . may denote representatives of the scanning lines $24_1$, $24_2$, $24_3$, . . . $24_m$, and signal lines $25_{n+1}$, $25_{n+2}$, $25_{n+3}$, . . . may denote representatives of the signal lines $25_1$, $25_2$, $25_3$, . . . $25_n$. When the display area 21 is seen from a direction orthogonal to the front, the scanning lines 24 and the signal lines 25 are arranged in regions overlapping with a black matrix of a color filter. A region in the display area 21 in which the black matrix is not arranged is an opening.

A master clock, a horizontal synchronization signal, and a vertical synchronization signal, which are external signals, are input to the display unit 2 from the outside and supplied to the driver IC 3. The driver IC 3 converts (boosts) the level of the master clock, the horizontal synchronization signal, and the vertical synchronization signal having a voltage amplitude of the external power source into signals having a voltage amplitude of the internal power source required for driving liquid crystals, to generate a master clock, a horizontal synchronization signal, and a vertical synchronization signal. The driver IC 3 supplies the generated master clock, horizontal synchronization signal, and vertical synchronization signal to the first vertical driver 22A, the second vertical driver 22B, and the horizontal driver 23, respectively. The driver IC 3 generates a common potential to be supplied to pixels in common to a pixel electrode 72 (see FIG. 5) for each subpixel Vpix, and supplies the common potential to the display area 21.

The first vertical driver 22A and the second vertical driver 22B each include a shift register and further include a latch circuit. In the first vertical driver 22A and the second vertical driver 22B, the latch circuit sequentially samples and latches display data output from the driver IC 3 in one horizontal period in synchronization with a vertical clock pulse. The first vertical driver 22A and the second vertical driver 22B sequentially output and supply digital data for one line latched in the latch circuit as a vertical scanning pulse to the scanning lines $24_{m+1}$, $24_{m+2}$, $24_{m+3}$, . . . in the display area 21 to sequentially select the subpixels Vpix row by row. The first vertical driver 22A and the second vertical driver 22B are arranged so as to sandwich the scanning lines $24_{m+1}$, $24_{m+2}$, $24_{m+3}$ . . . in the direction in which the scanning lines $24_{m+1}$, $24_{m+2}$, $24_{m+3}$ . . . extend. For example, the first vertical driver 22A and the second vertical driver 22B sequentially output digital data to the scanning lines $24_{m+1}$, $24_{m+2}$, $24_{m+3}$, . . . , from the top of the display area 21, that is, the upper side in the vertical scanning, to the bottom of the display area 21, that is, the lower side in the vertical scanning. The first vertical driver 22A and the second vertical driver 22B may sequentially output digital data to the scanning lines $24_{m+1}$, $24_{m+2}$, $24_{m+3}$, . . . , from the bottom of the display area 21, that is, the lower side in the vertical scanning, to the top of the display area 21, that is, the upper side in the vertical scanning. The upper side in the vertical scanning is one side along the arrangement direction of the scanning lines $24_{m+1}$, $24_{m+2}$, $24_{m+3}$, . . . . The lower side is a side opposite to the upper side.

The horizontal driver 23 is supplied with display data of red (R), green (G), blue (B), and white (W) having a predetermined number of bits (for example, 6 bits). The horizontal driver 23 writes the display data into subpixels Vpix in the row selected in the vertical scanning performed by the first vertical driver 22A and the second vertical driver 22B, for each pixel Pix, for each set of a plurality of pixels, or for all the pixels through the signal lines 25.

Figure 3:
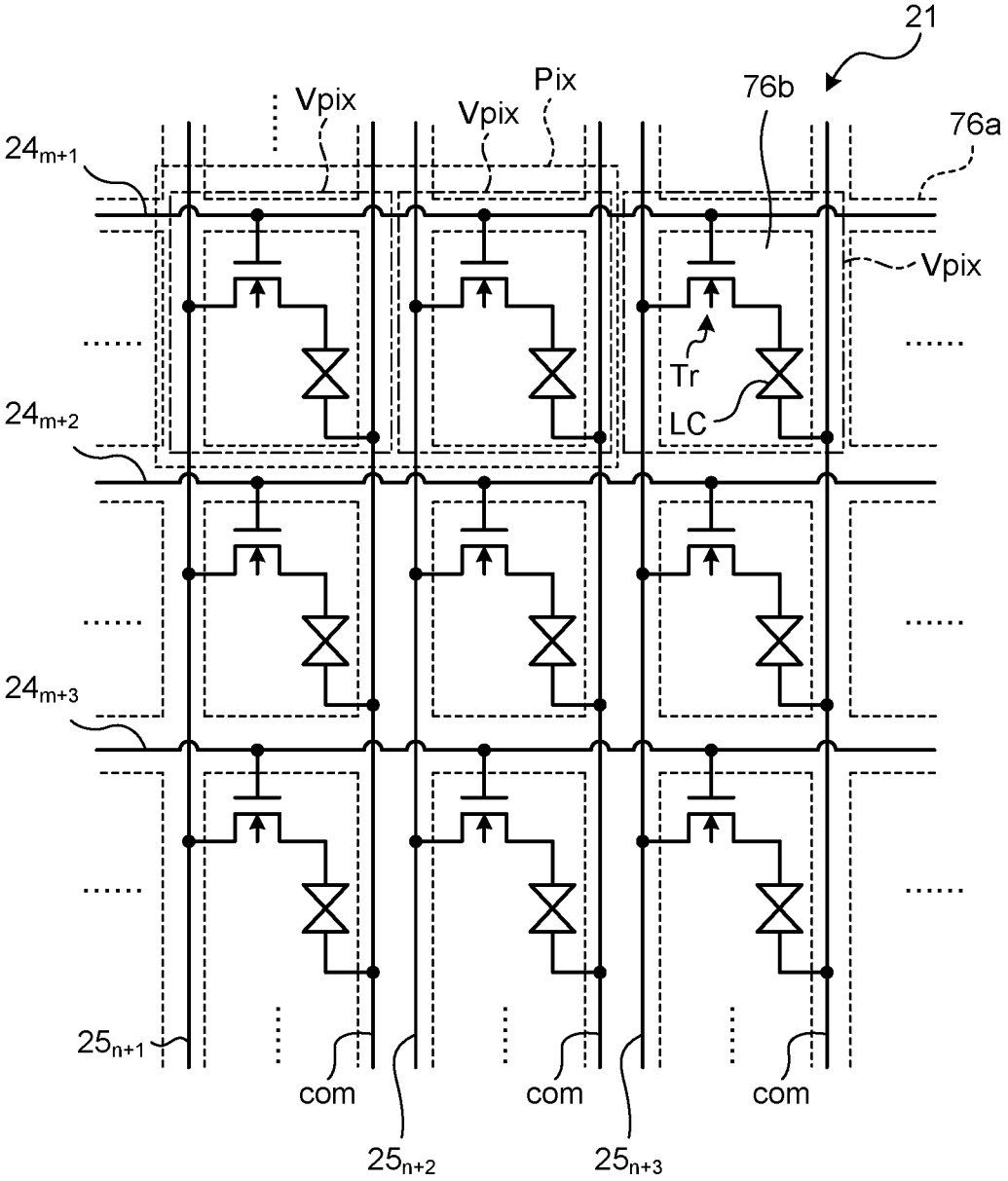
FIG. 3 is a circuit diagram illustrating an example of a drive circuit configured to drive pixels.

FIG. 3 is a circuit diagram illustrating an example of a drive circuit configured to drive pixels Pix. In the display area 21, wiring such as the signal lines $25_{n+1}$, $25_{n+2}$, and $25_{n+3}$ and the scanning lines $24_{m+1}$, $24_{m+2}$, and $24_{m+3}$ is disposed. The signal lines $25_{n+1}$, $25_{n+2}$, and $25_{n+3}$ supply pixel signals to thin film transistors (TFTs) Tr in subpixels Vpix illustrated in FIG. 3 as display data, and the scanning lines $24_{m+1}$, $24_{m+2}$, and $24_{m+3}$ drive the thin film transistors Tr. In this manner, the signal lines $25_{n+1}$, $25_{n+2}$, and $25_{n+3}$ extend on a plane parallel to the surface of the glass substrate 11 described above, and supply the subpixels Vpix with pixel signals for displaying images. Each of the subpixels Vpix includes a thin film transistor Tr and a liquid crystal element LC. The thin film transistor Tr, in the present example, is formed of an n-channel metal oxide semiconductor (MOS) TFT. One of a source and a drain of the thin film transistor Tr is coupled to a corresponding one of the signal lines $25_{n+1}$, $25_{n+2}$, and $25_{n+3}$, a gate thereof is coupled to a corresponding one of the scanning lines $24_{m+1}$, $24_{m+2}$, and $24_{m+3}$, and the other of the source and the drain is coupled to one end of the liquid crystal element LC. The liquid crystal element LC has one end coupled to the thin film transistor Tr and the other end coupled to a corresponding one of common electrodes com.

The subpixel Vpix is coupled to other subpixels Vpix belonging to the same row in the display area 21 through a corresponding one of the scanning lines $24_{m+1}$, $24_{m+2}$, and $24_{m+3}$. The odd-numbered scanning lines $24_{m+1}$ and $24_{m+3}$ among the scanning lines $24_{m+1}$, $24_{m+2}$, and $24_{m+3}$ are coupled to the first vertical driver 22A, and supplied with a vertical scanning pulse of a scanning signal described later from the first vertical driver 22A. The even-numbered scanning lines $24_{m+2}$ and $24_{m+4}$ among the scanning lines $24_{m+1}$, $24_{m+2}$, and $24_{m+3}$ are coupled to the second vertical driver 22B, and supplied with a vertical scanning pulse of a scanning signal described later from the second vertical driver 22B. In this manner, the first vertical driver 22A and the second vertical driver 22B alternately apply vertical scanning pulses to the scanning lines $24_{m+1}$, $24_{m+2}$, and $24_{m+3}$ arranged in the scanning direction. A subpixel Vpix is coupled to other subpixels Vpix belonging to the same column in the display area 21 through a corresponding one of the signal lines $25_{n+1}$, $25_{n+2}$, and $25_{n+3}$. The signal lines $25_{n+1}$, $25_{n+2}$, and $25_{n+3}$ are coupled to the horizontal driver 23 and supplied with pixel signals from the horizontal driver 23. The common electrode com is coupled to a drive electrode driver (not illustrated), and supplied with a voltage from the drive electrode driver. A subpixel Vpix is coupled to other subpixels Vpix belonging to the same column in the display area 21 through a corresponding one of the common electrodes com.

The first vertical driver 22A and the second vertical driver 22B illustrated in FIG. 1 and FIG. 2 apply the vertical scanning pulse to the gates of the thin film transistors Tr in the subpixels Vpix through the scanning lines $24_{m+1}$, $24_{m+2}$, and $24_{m+3}$ illustrated in FIG. 3, thereby sequentially selecting one row (one horizontal line) among the subpixels Vpix arranged in a matrix (row-column configuration) in the display area 21 as display driving targets. The horizontal driver 23 illustrated in FIG. 1 and FIG. 2 supplies the pixel signals to the respective subpixels Vpix included in one horizontal line sequentially selected by the first vertical driver 22A and the second vertical driver 22B, through the signal lines $25_{n+1}$, $25_{+2}$, and $25_{n+3}$ illustrated in FIG. 3. In these subpixels Vpix, the display of one horizontal line is performed in accordance with the supplied pixel signals.

As described above, in the display device 1, the first vertical driver 22A and the second vertical driver 22B are driven to sequentially scan the scanning lines $24_{m+1}$, $24_{m+2}$, and $24_{m+3}$, thereby sequentially selecting one horizontal line. In the display device 1, the horizontal driver 23 supplies pixel signals to subpixels Vpix belonging to one horizontal line, thereby performing display for each horizontal line. To perform this display operation, the drive electrode driver applies voltage to the common electrode.

In the display device 1, the specific resistance (substance-specific resistance value) of liquid crystal may deteriorate when the liquid crystal element LC is continuously applied with DC voltage having the same polarity. To prevent the deterioration in specific resistance (substance-specific resistance value) of liquid crystals, the display device 1 employs a driving method in which the polarity of the pixel signal is inverted in a predetermined cycle relative to a driving signal.

Known examples of the driving method for the display device 1 include a column inversion driving method, a line inversion driving method, a dot inversion driving method, and a frame inversion driving method. The column inversion driving method is a driving method in which the polarity of the pixel signal is inverted in a time period of 1V (V is a vertical period) corresponding to one column (one pixel column). The line inversion driving method is a driving method in which the polarity of the pixel signal is inverted in a time period of 1H (H is a horizontal period) corresponding to one line (one pixel row). The dot inversion driving method is a driving method in which the polarity of the pixel signal is alternately inverted for each of pixels Pix that are adjacent to one another in the horizontal and vertical directions. The frame inversion driving method is a driving method in which the polarities of pixel signals to be written in all pixels are inverted at the same time for each frame corresponding to one screen.

Figure 4:
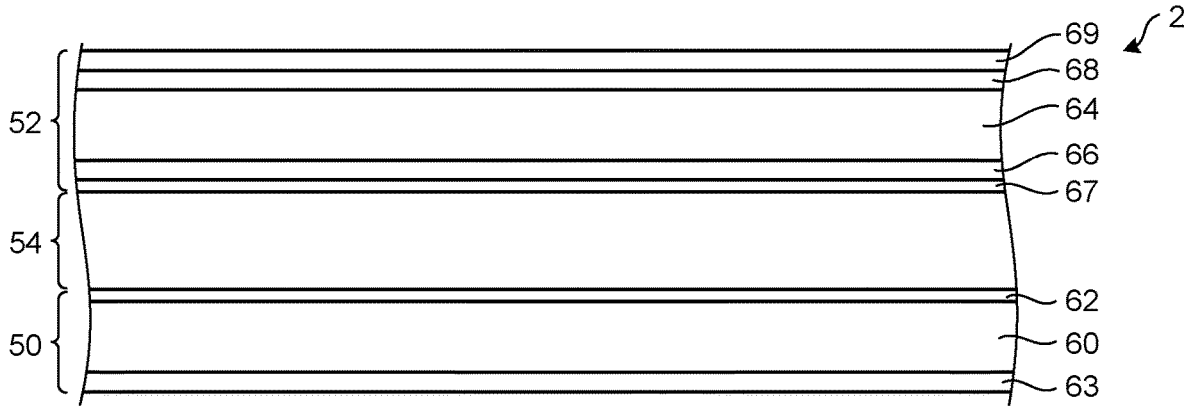
FIG. 4 is a schematic diagram illustrating an example of a cross-sectional structure of a display unit.

Next, the configuration of the display area 21 is described in detail. FIG. 4 is a schematic diagram illustrating an example of the cross-sectional structure of the display unit 2. As illustrated in FIG. 4, the display unit 2 includes the first substrate (upper substrate) 50, the second substrate (lower substrate) 52 arranged to be opposed to the first substrate 50 in a direction perpendicular to the surface of the first substrate 50, and a liquid crystal layer 54 interposed between the first substrate 50 and the second substrate 52. The backlight 6 is arranged on a surface of the first substrate 50 opposite to a surface facing the liquid crystal layer 54.

The liquid crystal layer 54 modulates light passing therethrough in accordance with the state of electric field. Liquid crystal molecules included in the liquid crystal layer 54 constitute liquid crystal elements LC in units of subpixels Vpix. In the first embodiment, a transverse electric field mode such as fringe field switching (FFS) and IPS is employed. That is, liquid crystal molecules rotate between two substrates (first substrate 50 and second substrate 52) within a plane parallel to the two substrates. Specifically, liquid crystal molecules are driven not to be rotated in a direction rising to the arrangement direction of the two substrates but to change their orientation angles along a plane orthogonal to the arrangement direction.

The first substrate 50 includes a pixel substrate 60, a first orientation film 62, and a first polarization plate 63. The pixel substrate 60 is a translucent substrate such as glass. The first orientation film 62 is stacked on a liquid crystal layer 54 side of the pixel substrate 60. The first polarization plate 63 is stacked on a side of the pixel substrate 60 opposite to the liquid crystal layer 54 side thereof. The pixel substrate 60 is described later. The first orientation film 62 orients liquid crystal molecules in the liquid crystal layer 54 to a predetermined direction and is in direct contact with the liquid crystal layer 54. For example, the first orientation film 62 is made of a polymer material such as polyimide, and for example, formed by rubbing coated polyimide. The first polarization plate 63 has the function of converting light entering from the backlight 6 into linearly polarized light.

The second substrate 52 includes a counter substrate 64, a color filter 66, a second orientation film 67, a phase difference plate 68, and a second polarization plate 69. The counter substrate 64 is a translucent substrate such as glass. The color filter 66 is disposed on the liquid crystal layer 54 side of the counter substrate 64. The second orientation film 67 is disposed on the liquid crystal layer 54 side of the color filter 66. The phase difference plate 68 is disposed on a side of the counter substrate 64 opposite to the liquid crystal layer 54 side thereof. The second polarization plate 69 is disposed on a side of the phase difference plate 68 opposite to the counter substrate 64 side thereof. For example, the color filter 66 includes color regions colored with three colors of red (R), green (G), and blue (B). The color filter 66 in the first embodiment includes a region that is not colored and transmits light of all colors. The non-colored region is hereinafter referred to as "color region of white (W)". For example, the color filter 66 includes color regions of four colors of red (R), green (G), blue (B), and white (W) at the openings 76*b*. The color of a subpixel Vpix is determined in accordance with the color of the color filter 66 when the color filter 66 is provided. The color filter 66 of white (W) may be omitted, and the colors of subpixels Vpix may be limited to the three colors. Openings 76*b* at which the color filter 66 is not provided may be provided in order to form color regions of white (W).

In the first embodiment, two subpixels Vpix arranged in the row direction are paired and associated with each other as a pixel Pix. The color filter 66 is opposed to the liquid crystal layer 54 in a direction perpendicular to the pixel substrate 60. The color filter 66 may be made by a combination of other colors as long as the color filter 66 is colored with different colors. In general, in the color filter 66, the luminance of the color region of green (G) is higher than the luminance of the color region of red (R) and the color region of blue (B). In the color filter 66, a black matrix 76*a* may be provided so as to cover the outer periphery of the subpixels Vpix illustrated in FIG. 3. When arranged at boundaries between the subpixels Vpix that are two-dimensionally arranged, the black matrix 76*a* has a lattice shape. The black matrix 76*a* is made of a material having high light absorptivity.

In the same manner as the first orientation film 62, the second orientation film 67 orients liquid crystal molecules in the liquid crystal layer 54 to a predetermined direction and is in direct contact with the liquid crystal layer 54. For example, the second orientation film 67 is made of a polymer material such as polyimide, and for example, formed by rubbing coated polyimide. The phase difference plate 68 has a function of compensating for reduction in viewing angles caused by the first polarization plate 63 and the second polarization plate 69. The second polarization plate 69 has a function of absorbing linearly polarized components parallel to the polarization plate absorption axis and transmitting polarized components orthogonal to the polarization plate absorption axis. The second polarization plate 69 has a function of transmitting/blocking light depending on the ON/OFF state of liquid crystals. One surface of the second polarization plate 69 located on the side of the phase difference plate 68 opposite to the counter substrate 64 side thereof is a display surface in the first embodiment.

As described above, in the first embodiment, the orientation of liquid crystal molecules in the liquid crystal element LC included in each subpixel Vpix is determined in accordance with the first orientation film 62 and the second orientation film 67.

Figure 5:
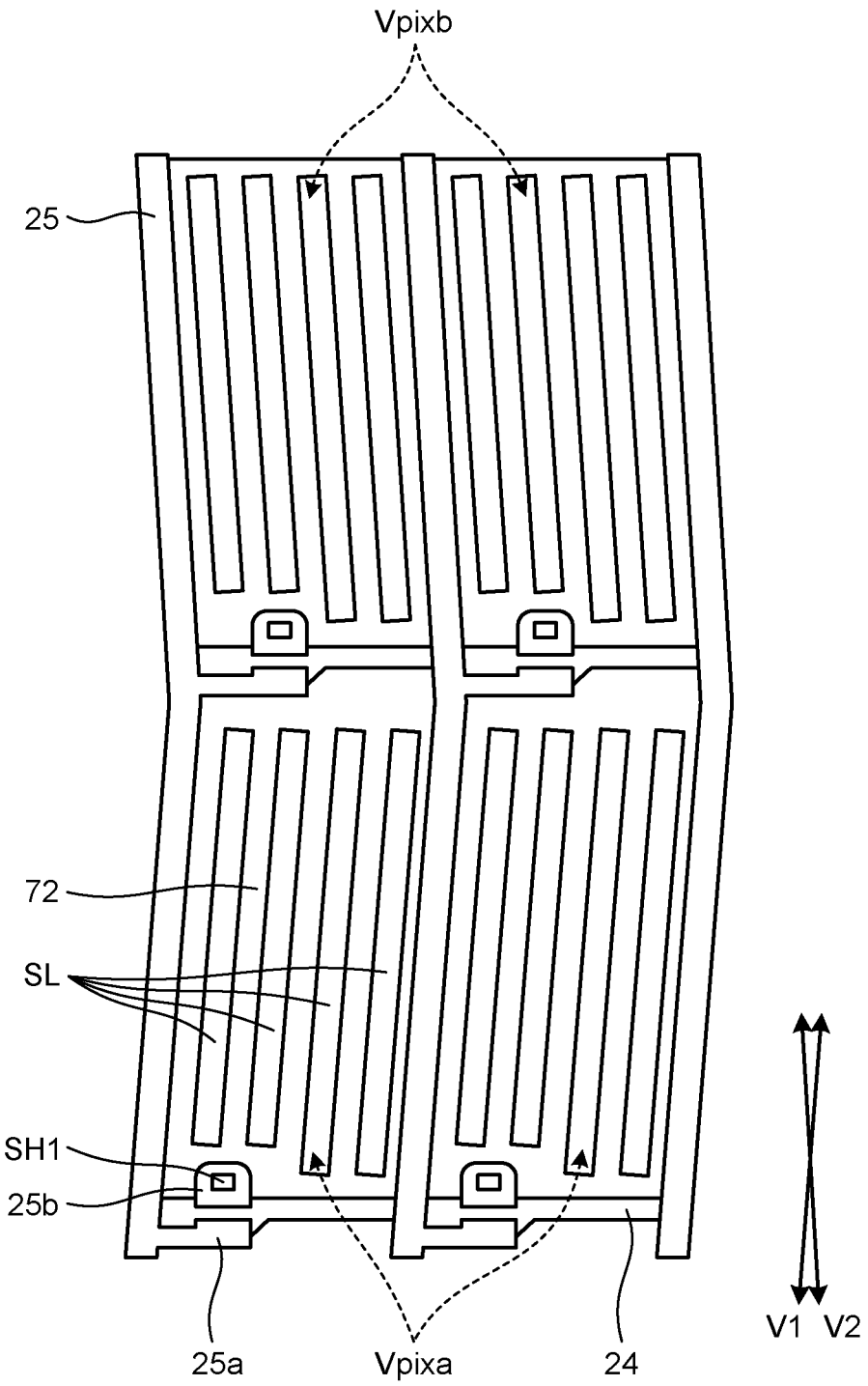
FIG. 5 is a plan view schematically illustrating pixels in the display device according to the first embodiment.
Figure 6:
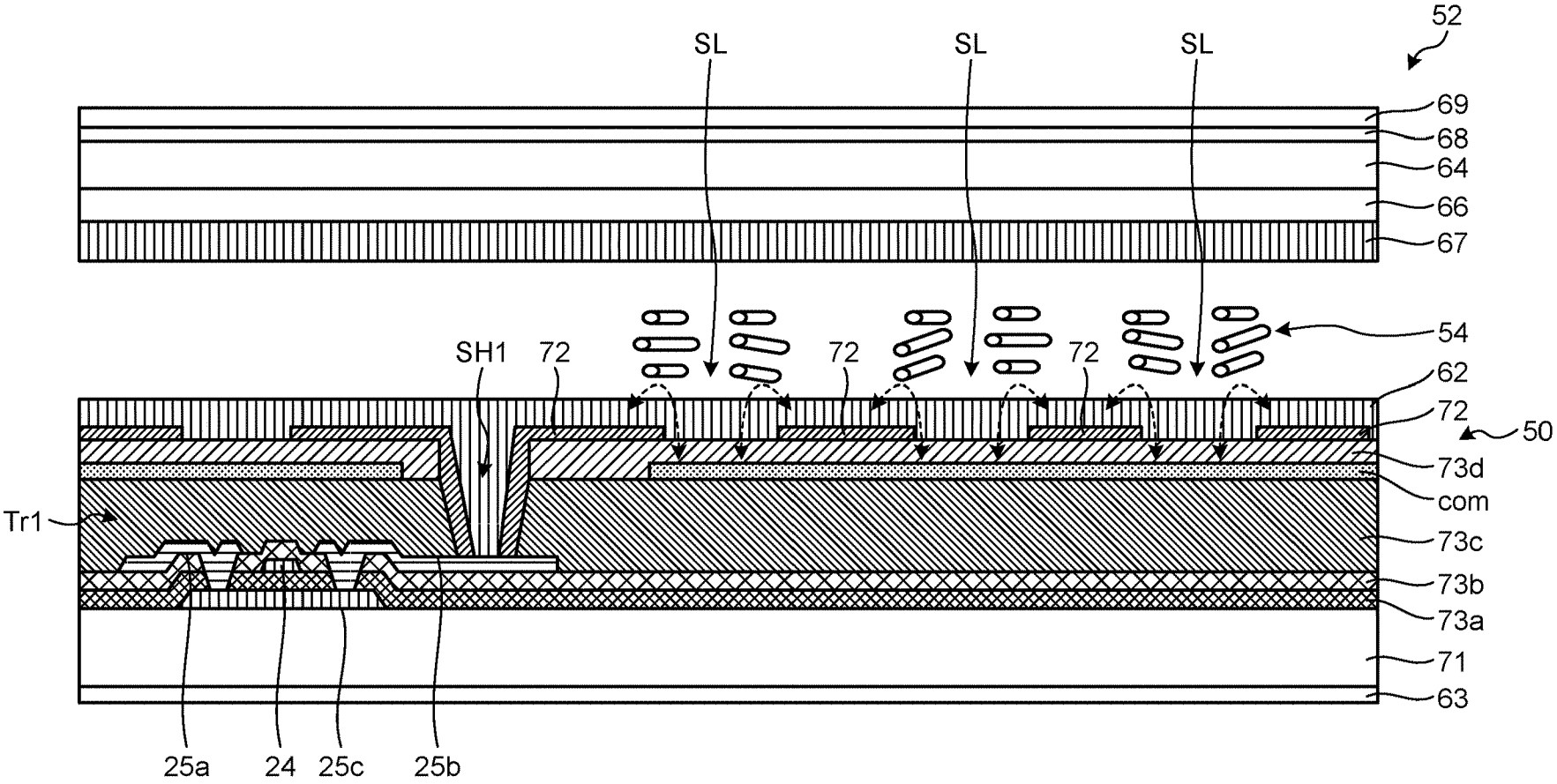
FIG. 6 is a cross-sectional view schematically illustrating an example of a transistor configured to switch pixels in the display device according to the first embodiment.

Next, the pixel substrate 60 is described with reference to FIG. 5 and FIG. 6. FIG. 5 is a plan view schematically illustrating the pixels Pix in the display device 1 according to the first embodiment. FIG. 6 is a cross-sectional view schematically illustrating an example of transistors configured to switch the pixels Pix in the display device 1 according to the first embodiment. The pixel substrate 60 includes a TFT substrate in which various circuits are provided on the translucent substrate 71, and includes a plurality of pixel electrodes 72 arranged on the TFT substrate in a matrix (row-column configuration) and the common electrode com. As illustrated in FIG. 6, the pixel electrodes 72 and the common electrode com are insulated from each other by a fourth insulating film 73*d*, and are opposed to each other in a direction vertical to the surface of the pixel substrate 60. The pixel electrodes 72 and the common electrode com are translucent electrodes made of a translucent conductive material (translucent conductive oxide), such as indium tin oxide (ITO).

When a thin film transistor Tr serving as a switching element of a subpixel Vpix illustrated in FIG. 3 is a transistor Tr1, the pixel substrate 60 is formed by stacking an island 25*c* and wiring on the translucent substrate 71. The island 25*c* is a semiconductor layer in which the transistor Tr1 serving as a switching element of each subpixel Vpix described above is provided. The wiring includes the signal lines 25 for supplying pixel signals to pixel electrodes 72 and the scanning lines 24 for driving the transistors Tr1.

As illustrated in FIG. 5 and FIG. 6, the scanning line 24 three-dimensionally crosses with a part of the island 25*c* and functions as a gate of the transistor Tr1. In the transistor Tr1, an n-channel region ch is patterned by the electrical coupling of, for example, a source line 25*a*, a drain line 25*b*, and the island 25*c*. For example, the semiconductor layer is made of low-temperature polysilicon. The signal line 25 extends on a plane parallel to the surface of the translucent substrate 71 and supplies the pixel Pix with a pixel signal for displaying an image. A part of the semiconductor layer is in contact with the source line 25*a* in the signal line 25, and the other part is electrically coupled to the drain line 25*b* provided in the same layer as the signal line 25. The drain line 25*b* in the first embodiment is electrically coupled to the pixel electrode 72 in a through hole SH1. In the first embodiment, for example, the scanning line 24 is wiring of metal such as molybdenum (Mo) and aluminum (Al), and the signal line 25 is wiring of metal such as aluminum. In the pixel substrate 60 of the first embodiment, the island 25*c*, a first insulating film 73*a*, the scanning lines 24, a second insulating film 73*b*, the signal lines 25 (including the source lines 25*a* and the drain lines 25*b*), a third insulating film 74*a*, the common electrodes com, a fourth insulating film 73*d*, and the pixel electrodes 72 are stacked on the translucent substrate 71 in this order. The first orientation film 62 is disposed between the pixel electrodes 72 and liquid crystal layer 54. The first orientation film 62 may be included in the configuration of the pixel substrate.

The first insulating film 73*a*, the second insulating film 73*b*, a third insulating film 73*c*, and the fourth insulating film 73*d* in the first embodiment are made of an inorganic insulating material, such as nitride silicon (SiNx) or oxide silicon, or an organic insulating material, such as polyimide resin. The material forming each layer of the first insulating film 73*a*, the second insulating film 73*b*, the third insulating film 73*c*, and the fourth insulating film 73*d* is not limited thereto. The first insulating film 73*a*, the second insulating film 73*b*, the third insulating film 73*c*, and the fourth insulating film 73*d* may be made of the same insulating material, or a part or all thereof may be made of different insulating materials.

In the pixel substrate 60, an opening SL is formed in the pixel electrode 72 corresponding to each subpixel Vpix. Among electric fields generated between the common electrode com and the pixel electrode 72, an electric field (fringe electric field) leaking from the openings SL in the pixel electrode 72 drives liquid crystals in the liquid crystal layer 54. As described above, the display unit 2 in the first embodiment is a liquid crystal panel configured to rotate, in accordance with potentials supplied to electrodes (pixel electrodes 72) provided on one substrate (for example, pixel substrate 60) of the two opposed substrates (pixel substrate 60 and counter substrate 64), liquid crystal molecules in the liquid crystal layer 54 provided between the two substrates.

The longitudinal direction of the openings SL illustrated in FIG. 5 is a direction along the orientation of liquid crystal molecules in each subpixel Vpix. A direction in which the subpixels Vpix extend is the same as the longitudinal direction of their openings SL. The subpixels Vpix include a first subpixel Vpixa and a second subpixel Vpixb. The orientation of liquid crystal molecules in the first subpixels Vpixa illustrated in FIG. 5 is along the first direction V1. The orientation of liquid crystal molecules in the second subpixels Vpixb illustrated in FIG. 5 is along the second direction V2. Two directions of the first direction V1 and the second direction V2 intersecting with each other are directions along the display surface of the display unit 2 and are different from the row and column directions. As illustrated in FIG. 5, the subpixels Vpix include the first subpixels Vpixa and the second subpixels Vpixb. The longitudinal direction of the openings SL in the pixel electrode 72 of each first subpixel Vpixa is the first direction V1, and the longitudinal direction of the openings SL in the pixel electrode 72 of each second subpixel Vpixb is the second direction V2. In this manner, the display unit 2 in the first embodiment is a liquid crystal panel of what is called a pseudo multi-domain including subpixels Vpix having different orientations of liquid crystal molecules. It is preferred that the first direction and the second direction have the same acute angle formed with at least one of a third direction and a fourth direction so as to have symmetric relation with respect to the at least one direction. The first direction and the second direction may be asymmetric, and are not necessarily required to have the same acute angle formed with respect to the at least one direction.

Figure 7:
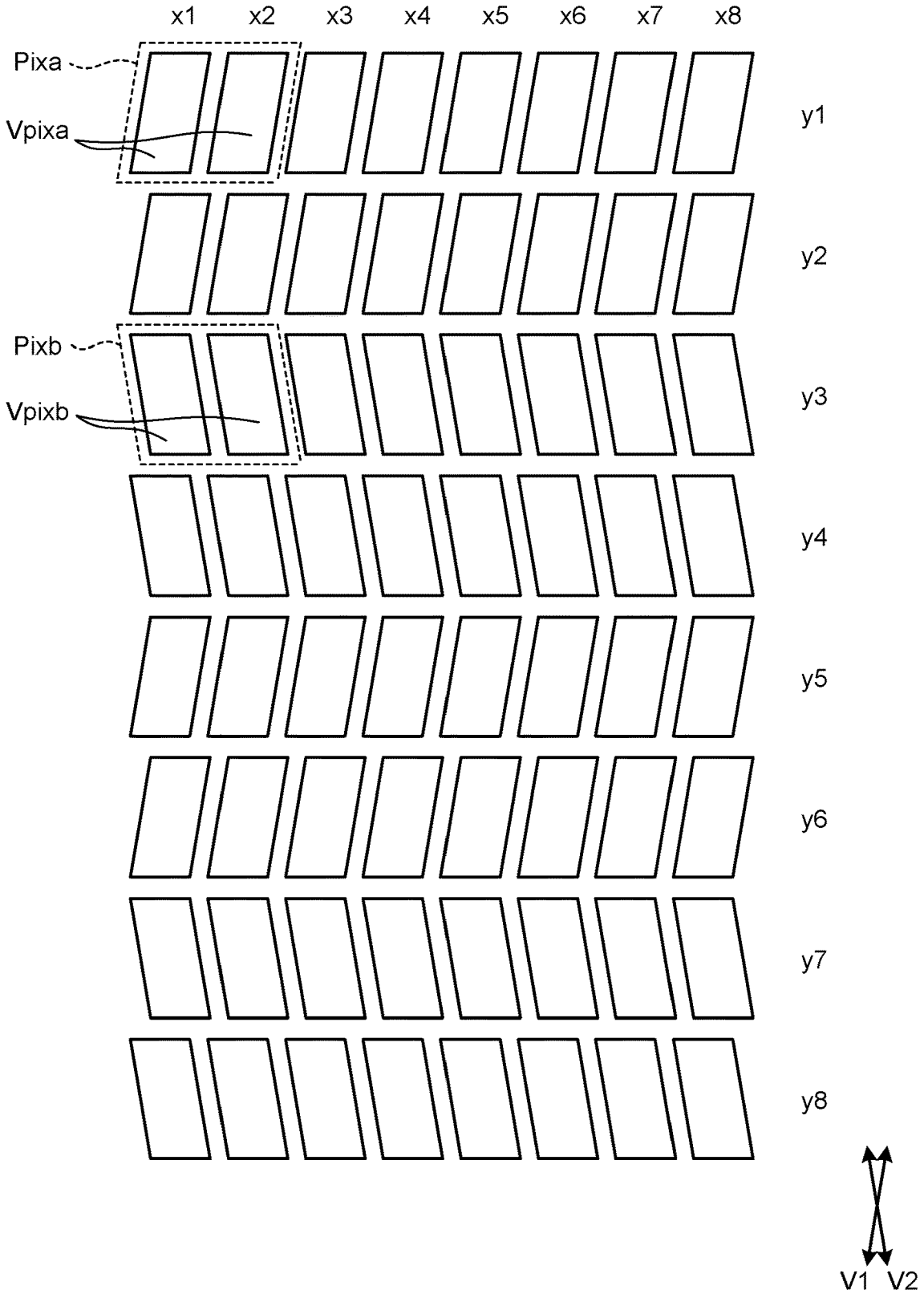
FIG. 7 is a diagram illustrating an arrangement example of first subpixels and second subpixels in the first embodiment.
Figure 10:
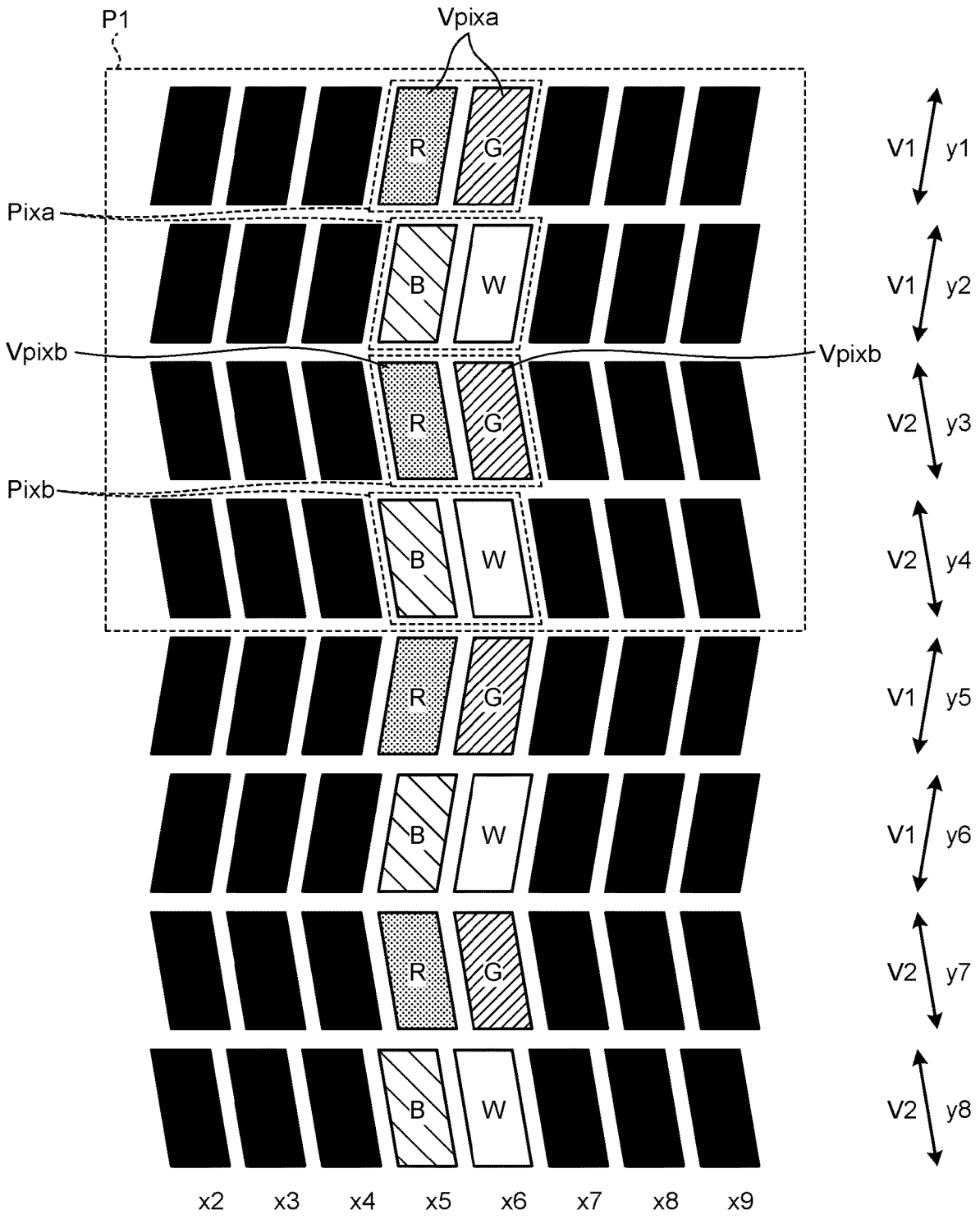
FIG. 10 is a schematic diagram illustrating an example where display output corresponding to the display pattern in FIG. 9 is performed by the display device in the first embodiment having the arrangement pattern of pixels and subpixels illustrated by Pattern 1-1 in FIG. 8.

FIG. 7 is a diagram illustrating an arrangement example of first subpixels Vpixa and second subpixels Vpixb in the first embodiment. In FIG. 7 and other drawings, x1, x2, x3, x4, x5, x6, x7, and x8 are provided from one end side in the row direction as coordinates representing the positions of eight subpixels Vpix arranged in the row direction among the subpixels Vpix arranged in m rows and n columns. In FIG. 10 and other drawings referred to later, x2, x3, x4, x5, x6, x7, x8, and x9 are provided from one end side in the row direction as coordinates representing the positions of eight subpixels Vpix arranged in the row direction. y1, y2, y3, y4, y5, y6, y7, and y8 are provided from one end side in the column direction as coordinates representing the positions of eight subpixels Vpix arranged in the column direction.

In the first embodiment, two subpixels Vpix arranged in the row direction are paired and associated as a pixel Pix.

The pixel Pix includes a pixel Pixa having two first subpixels Vpixa and a pixel Pixb having two second subpixels Vpixb. Subpixels Vpix arranged in the row direction are first subpixels Vpixa or second subpixels Vpixb. For example, as illustrated in FIG. 7, all of the subpixels Vpix located at y1, y2, y5, and y6 are first subpixels Vpixa. All of the sub-pixels Vpix located at y3, y4, y'7, and y8 are second subpixels Vpixb. Specifically, the arrangement order of first subpixels Vpixa and second subpixels Vpixb corresponding to a predetermined number of (for example, four) subpixels Vpix counted from one end side in the column direction is repeated in a predetermined number of units. In FIG. 7, the arrangement order of first subpixels Vpixa and second subpixels Vpixb corresponding to four subpixels Vpix at y1, y2, y3, and y4 is repeated for four subpixels Vpix at y5, y6, y7, and y8. In the first embodiment, the arrangement of first subpixels Vpixa and second subpixels Vpixb is repeated in the column direction, with the predetermined number of subpixels as one cycle. In this manner, in the example illustrated in FIG. 7, the number of subpixels Vpix in which first subpixels Vpixa and second subpixels Vpixb constitute one cycle in the column direction is $4\alpha$. $\alpha$ is a natural number. The number of the first subpixels Vpixa with odd numbers, the number of the first subpixels Vpixa with even numbers, the number of the second subpixels Vpixb with odd numbers, and the number of the second subpixels Vpixb with even numbers when counted from one end side in the column direction within one cycle are equal to each other. In the case of the example illustrated in FIG. 7, the number of the first subpixels Vpixa with odd numbers, the number of the first subpixels Vpixa with even numbers, the number of the second subpixels Vpixb with odd numbers, and the number of the second subpixels Vpixb with even numbers when counted from one end side in the column direction within one cycle are each 1. In the first embodiment, $\alpha=1$. In the first embodiment, the number of the first subpixels Vpixa that are consecutive and the number of the second subpixels Vpixb that are consecutive, when they are counted from one end side in the column direction within one cycle, are equal to each other. Specifically, in the example illustrated in FIG. 7, the number of the consecutive first subpixels Vpixa and the number of the consecutive second subpixels Vpixb are 2.

Figure 8:
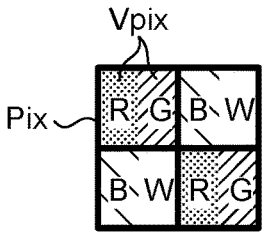
FIG. 8 is a diagram illustrating an arrangement pattern example of pixels and subpixels in the first embodiment.
Figure 8:
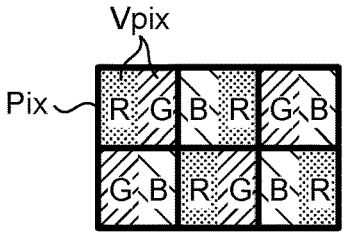

FIG. 8 is a diagram illustrating an arrangement pattern example of pixels Pix and subpixels Vpix in the first embodiment. As illustrated in FIG. 8, a plurality of subpixels Vpix included in one pixel Pix have different colors. In the first embodiment, subpixels Vpix adjacent in the row and column directions have different colors. Specifically, color regions of the color filter 66 are provided such that color regions of openings 76*b* formed by the color filters 66 included in the subpixels Vpix are different between the adjacent subpixels Vpix. In other words, the difference in color of the subpixels Vpix is the difference in color regions of the color filter 66.

In Pattern 1-1, a plurality of pixels Pix include an RG pixel having a subpixel Vpix of red (R) and a subpixel Vpix of green (G) and a BW pixel having a subpixel Vpix of blue (B) and a subpixel Vpix of white (W). In Pattern 1-1, the RG pixels and the BW pixels are alternately arranged along the row and column directions. Specifically, for example, the RG pixel has a subpixel Vpix of red (R) located on one end side in the row direction and a subpixel Vpix of green (G) located on the other end side in the row direction. For example, the BW pixel has a subpixel Vpix of blue (B) located on one end side in the row direction and a subpixel Vpix of white (W) located on the other end side in the row direction. The colors of the subpixels Vpix on one end side and the other end side may be reversed.

In Pattern 1-2, the pixels Pix include an RG pixel having a subpixel Vpix of red (R) and a subpixel Vpix of green (G), a BR pixel having a subpixel Vpix of red (R) and a subpixel Vpix of blue (B), and a GB pixel having a subpixel Vpix of green (G) and a subpixel Vpix of blue (B). In Pattern 1-2, the RG pixels, the BR pixels, and the GB pixels are periodically arranged in the row direction. In Pattern 1-2, two of the RG pixel, the BR pixel, and the GB pixel are arranged alternately in the column direction. In Pattern 1-2, subpixels Vpix of different colors are arranged adjacent to each other in the row and column directions. Specifically, for example, the BR pixel has a subpixel Vpix of blue (B) located on one end side in the row direction and a subpixel Vpix of red (R) located on the other end side in the row direction. For example, the GB pixel has a subpixel Vpix of green (G) located on one end side in the row direction and a subpixel Vpix of blue (B) located on the other end side in the row direction. The colors of the subpixels Vpix on one end side and the other end side may be reversed.

In the arrangement example of pixels Pix and subpixels Vpix in Pattern 1-1 and Pattern 1-2 illustrated in FIG. 8, the minimum arrangement unit of pixels Pix and subpixels Vpix is illustrated as a repetition unit in the row direction and the column direction. Specifically, in the display device 1 in the first embodiment in which Pattern 1-1 is employed, RG pixels and BW pixels are alternately arranged in the row direction and the column direction in the order of one of the RG pixel and the BW pixel, the other pixel thereof, the one pixel, the other pixel, . . . . In the display device 1 in the first embodiment in which Pattern 1-2 is employed, RG pixel, BR pixel, and GB pixel are periodically arranged in the row direction in the order of one of the RG pixel, the BR pixel, and the GB pixel, another one pixel, the remaining one pixel, the one pixel, the other one pixel, the remaining one pixel, . . . . Two of the RG pixel, the BR pixel, and the GB pixel are periodically arranged in the column direction in the order of one of the RG pixel, the BR pixel, and the GB pixel, another pixel, the one pixel, the other pixel, the one pixel, . . . . In this manner, in Pattern 1-1 and Pattern 1-2 illustrated in FIG. 8, the number of subpixels Vpix constituting one color pattern in the column direction is $2\alpha$.

When not all of the colors that subpixels Vpix can output are included in one pixel Pix, subpixel rendering is performed. In the subpixel rendering, a color component corresponding to a pixel signal that cannot be reproduced by one pixel Pix is allocated to another pixel having a subpixel Vpix corresponding to the color component. For example, when a pixel signal having a color component of blue (B) is input to an RG pixel, the color component of blue (B) is allocated to one or more of BW pixels adjacent to the RG pixel.

The arrangement pattern of pixels Pix and subpixels Vpix, that is, the arrangement pattern of color regions of the color filter 66, employed in the first embodiment may be any one of Pattern 1-1 and Pattern 1-2 illustrated in FIG. 8, and may be any other pattern (described later).

Figure 9:
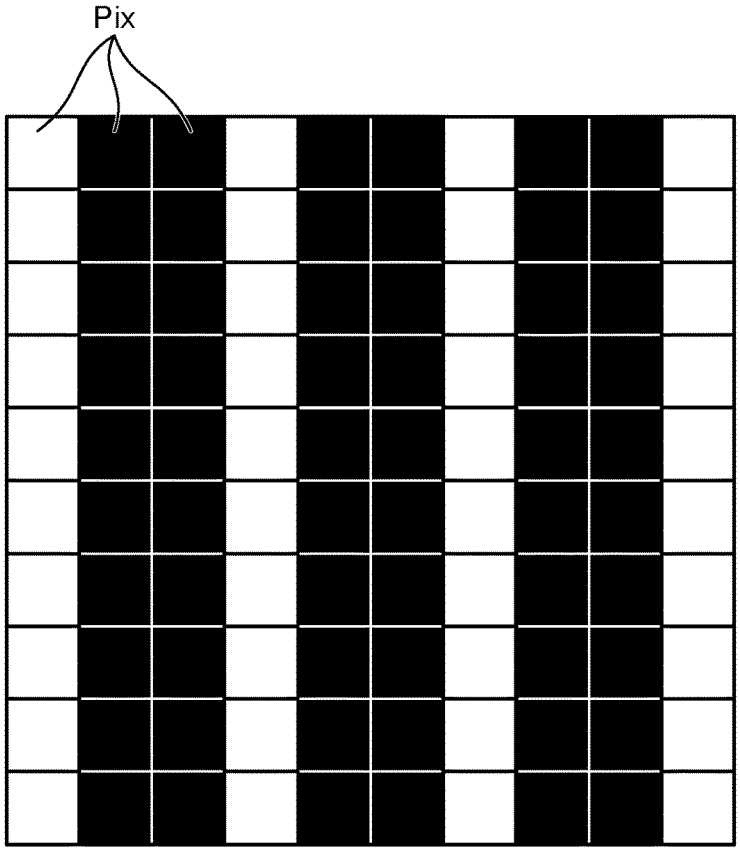
FIG. 9 is a diagram illustrating an example of a display pattern including bright and dark portions.

FIG. 9 is a diagram illustrating an example of a display pattern including bright and dark portions. The display pattern illustrated in FIG. 9 is a striped display pattern in which one pixel Pix supplied with a pixel signal of relatively high luminance (for example, (R,G,B)=(255,255,255)) and two pixels Pix supplied with a pixel signal of relatively low luminance (for example, (R,G,B)=(0,0,0)) are periodically arranged in the row direction and pixels Pix supplied with the same pixel signal are arranged in the column direction.

In the display pattern in FIG. 9, the arrangement of pixels Pix supplied with a pixel signal of relatively high luminance is represented by white rectangles, and the arrangement of pixels Pix supplied with a pixel signal of relatively low luminance is represented by black rectangles. Display outputs in FIG. 10, FIG. 11, FIG. 13, and FIG. 14 to be referred to in the following description correspond to the display pattern illustrated in FIG. 9. In FIG. 10 and other drawings, subpixels Vpix included in pixels Pix supplied with a pixel signal of relatively low luminance in FIG. 9 are colored black.

Figure 11:
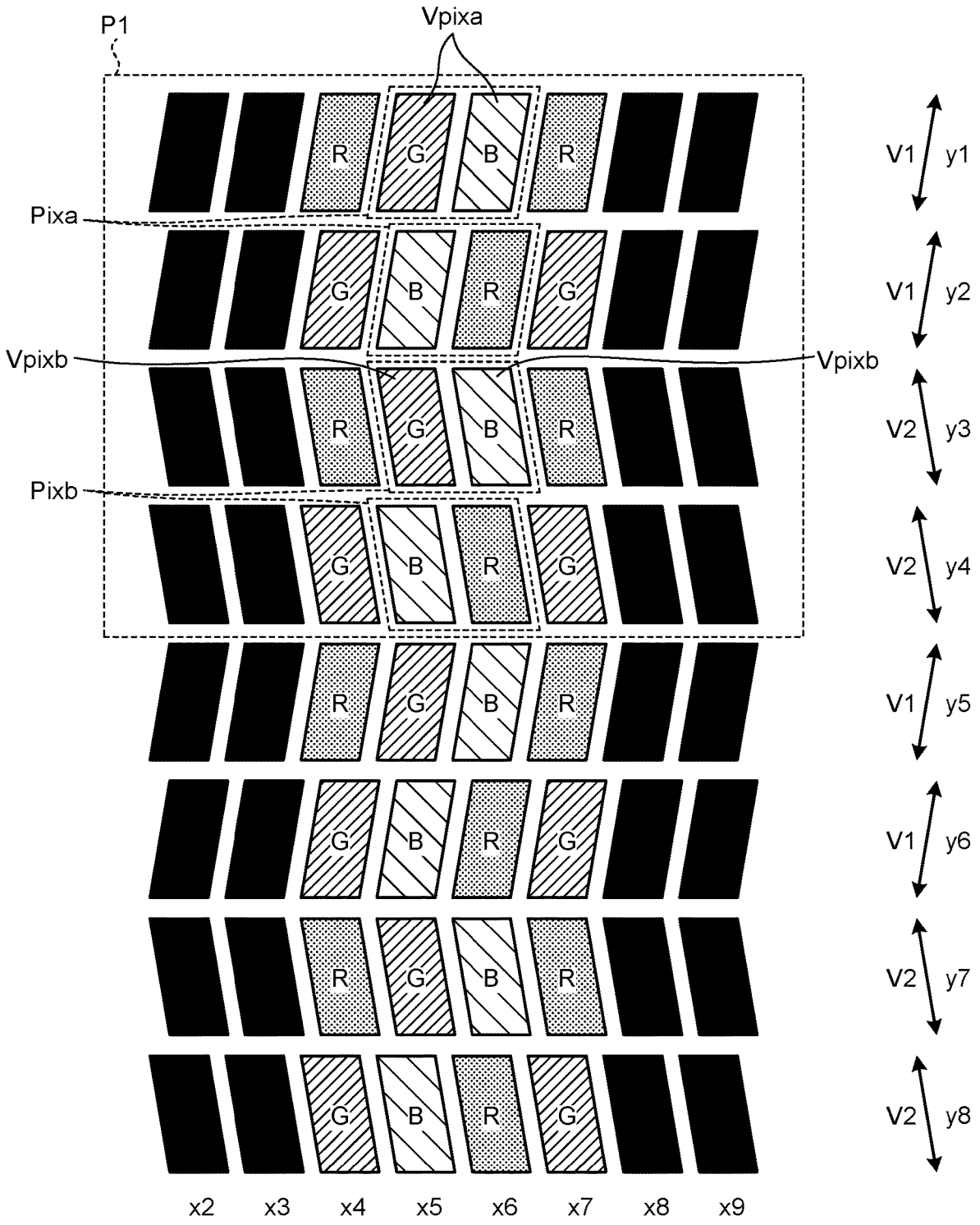
FIG. 11 is a schematic diagram illustrating an example where the display output corresponding to the display pattern in FIG. 9 is performed by the display device in the first embodiment having the arrangement pattern of pixels and subpixels illustrated by Pattern 1-2 in FIG. 8.

FIG. 10 is a schematic diagram illustrating an example where display output corresponding to the display pattern in FIG. 9 is performed by the display device 1 in the first embodiment having the arrangement pattern of pixels Pix and subpixels Vpix indicated by Pattern 1-1 in FIG. 8. FIG. 11 is a schematic diagram illustrating an example where the display output corresponding to the display pattern in FIG. 9 is performed by the display device in the first embodiment having the arrangement pattern of pixels Pix and subpixels Vpix indicated by Pattern 1-2 in FIG. 8. In the case of the display pattern illustrated in FIGS. 9 and 10, two subpixels Vpix corresponding to one column, that is, the width of one pixel, transmit light with relatively high transmittance. Four subpixels Vpix corresponding to two columns arranged in the row direction with respect to the two subpixels Vpix transmit light with relatively low transmittance (or do not transmit light) on one end side and the other end side in the row direction across the two subpixels Vpix. In FIG. 10, two subpixels Vpix included in one pixel Pix located at x5 and x6 transmit light with relatively high transmittance. In other words, in FIG. 10, the luminance of the subpixels Vpix at x5 and x6 is relatively high. In FIG. 11, subpixels Vpix located at x4, x5, x6, and x7 transmit light with relatively high transmittance. In other words, in FIG. 11, the luminance of the subpixels Vpix at x4, x5, x6, and x7 is relatively high. However, in FIG. 11, the luminance of the subpixels Vpix at x4 and x7 is lower than the luminance of the subpixels Vpix at x5 and x6. In FIG. 10, the subpixels Vpix located at x2, x3, x4, x7, x8, and x9 transmit light with relatively low transmittance (or do not transmit light). In FIG. 11, the subpixels Vpix located at x2, x3, x8, and x9 transmit light with relatively low transmittance (or do not transmit light).

In FIG. 10 and FIG. 11, one cycle (four rows) of first subpixels Vpixa and second subpixels Vpixb arranged in the column direction is surrounded by a broken line P1. In FIG. 10, among the subpixels Vpix that transmit light with relatively high transmittance in the one cycle, the colors of first subpixels Vpixa and the number of the first subpixels Vpixa per color are one each for red (R), green (G), blue (B), and white (W). In FIG. 10, among the subpixels Vpix that transmit light with relatively high transmittance in the one cycle, the colors of second subpixels Vpixb and the number of the second subpixels Vpixb per color are one each for red (R), green (G), blue (B), and white (W).

When one column located at x5 and x6 is a pixel column including GB pixels and BR pixels as illustrated in FIG. 11, among the subpixels Vpix that transmit light with relatively high transmittance in the one cycle indicated by the broken line P1, the colors of first subpixels Vpixa and the number of the first subpixels Vpixa per color are one each for red (R) and green (G), and two for blue (B). Among the subpixels Vpix that transmit light with relatively high transmittance in the one cycle, the colors of second subpixels Vpixb and the number of the second subpixels Vpixb per color are one each for red (R) and green (G), and two for blue (B).

Although not illustrated, when one column located at x5 and x6 is a pixel column including RG pixels and BR pixels, among the subpixels Vpix that transmit light with relatively high transmittance in the one cycle, the colors of first subpixels Vpixa and the number of the first subpixels Vpixa per color are two for red (R) and one each for green (G) and blue (B), and the colors of second subpixels Vpixb and the number of the second subpixels Vpixb per color are the same as those of the first subpixels Vpixa. When one column located at x5 and x6 is a pixel column including RG pixels and GB pixels, among the subpixels Vpix that transmit light with relatively high transmittance in the one cycle, the colors of first subpixels Vpixa and the number of the first subpixels Vpixa per color are one each for red (R) and blue (B) and two for green (G), and the colors of second subpixels Vpixb and the number of the second subpixels Vpixb per color are the same as those of the first subpixels Vpixa.

In the example where the colors of subpixels Vpix are three colors of red (R), green (G), and blue (B) as illustrated in FIG. 11 and other drawings, light is also transmitted through subpixels Vpix of a color that is not included in pixels Pix in one pixel column that transmit light with relatively high transmittance, the subpixels Vpix of the non-included color being subpixels Vpix (adjacent subpixels) adjacent to the one column on one end side and the other end side in the row direction. In this manner, output corresponding to pixel signals of relatively high luminance is performed. For example, each of the adjacent subpixels is controlled to transmit light (half-reduced light) that is a half of light in pixels Pix in one pixel column that transmit light with relatively high transmittance.

When subpixels Vpix in adjacent pixels are located at x4 and x7 as illustrated in FIG. 11, among the subpixels Vpix that transmit half-reduced light in the one cycle indicated by the broken line P1, the colors of first subpixels Vpixa and the number of the first subpixels Vpixa per color are two each for red (R) and green (G). Among the subpixels Vpix that transmit half-reduced light in the one cycle, the colors of second subpixels Vpixb and the number of the second subpixels Vpixb per color are two each for red (R) and green (G). In the embodiments, such as the first embodiment, one pixel Pix has two subpixels Vpix, and the subpixel rendering is thus performed. However, the configuration is not limited thereto. One pixel Pix may have three or more subpixels Vpix. The subpixel rendering is not necessarily required to be performed if all colors corresponding to pixel signals can be reproduced by subpixels Vpix included in one pixel Pix.

Although not illustrated, when one column located at x5 and x6 is a pixel column including RG pixels and BR pixels, among the subpixels Vpix that transmit half-reduced light in the one cycle, the colors of first subpixels Vpixa and the number of the first subpixels Vpixa per color are two each for green (G) and blue (B), and the colors of second subpixels Vpixb and the number of the second subpixels Vpixb per color are the same as those of the first subpixels Vpixa. When one column located at x5 and x6 is a pixel column including RG pixels and GB pixels, among the subpixels Vpix that transmit half-reduced light in the one cycle, the colors of first subpixels Vpixa and the number of the first subpixels Vpixa per color are two each for red (R) and blue (B), the colors of second subpixels Vpixb and the number of the second subpixels Vpixb per color are the same as those of the first subpixels Vpixa.

As described above, according to the first embodiment in which Pattern 1-1 and Pattern 1-2 are employed, the colors of first subpixels Vpixa included in one cycle and the number of the first subpixels Vpixa per color are the same as those of second subpixels Vpixb included in the one cycle. This uniformity is established both within one column (see FIG. 3) and within two or more columns.

In the first embodiment, as illustrated in FIG. 10, adjacent subpixels that transmit half-reduced light are not set in Pattern 1-1. The reason is that red (R), green (G), and blue (B) are uniformly included in one column located at x5 and x6. Even when Pattern 1-1 is employed, the adjacent subpixels that transmit half-reduced light may be set. Even when the adjacent subpixels that transmit half-reduced light are set in Pattern 1-1, the colors of first subpixels Vpixa included in one cycle and the number of the first subpixels Vpixa per color are the same as those of second subpixels Vpixb included in the one cycle.

Figure 12:
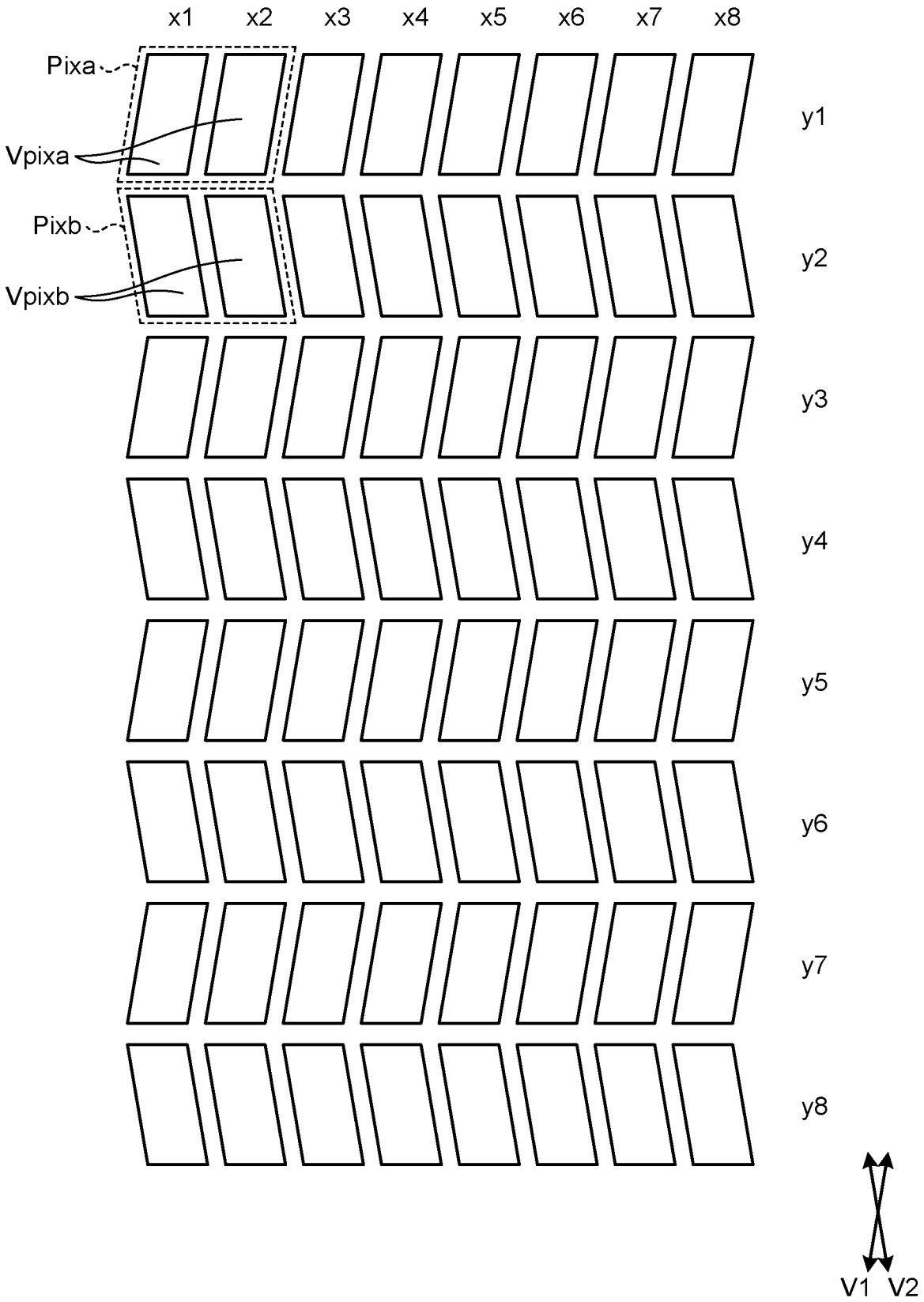
FIG. 12 is a diagram illustrating an arrangement example of first subpixels and second subpixels in a reference example.

FIG. 12 is a diagram illustrating an arrangement example of subpixels Vpix (first subpixels Vpixa and second subpixels Vpixb) in a reference example. In the reference example illustrated in FIG. 12, all of the subpixels Vpix located at y1, y3, y5, and y7 are first subpixels Vpixa. All of the sub-pixels Vpix located at y2, y4, y6, and y8 are second subpixels Vpixb. In this manner, in the reference example, first subpixels Vpixa and second subpixels Vpixb are alternately arranged in the column direction. Specifically, in the reference example, the number of subpixels Vpix in which first subpixels Vpixa and second subpixels Vpixb constitute one cycle in the column direction is 2.

Figure 13:
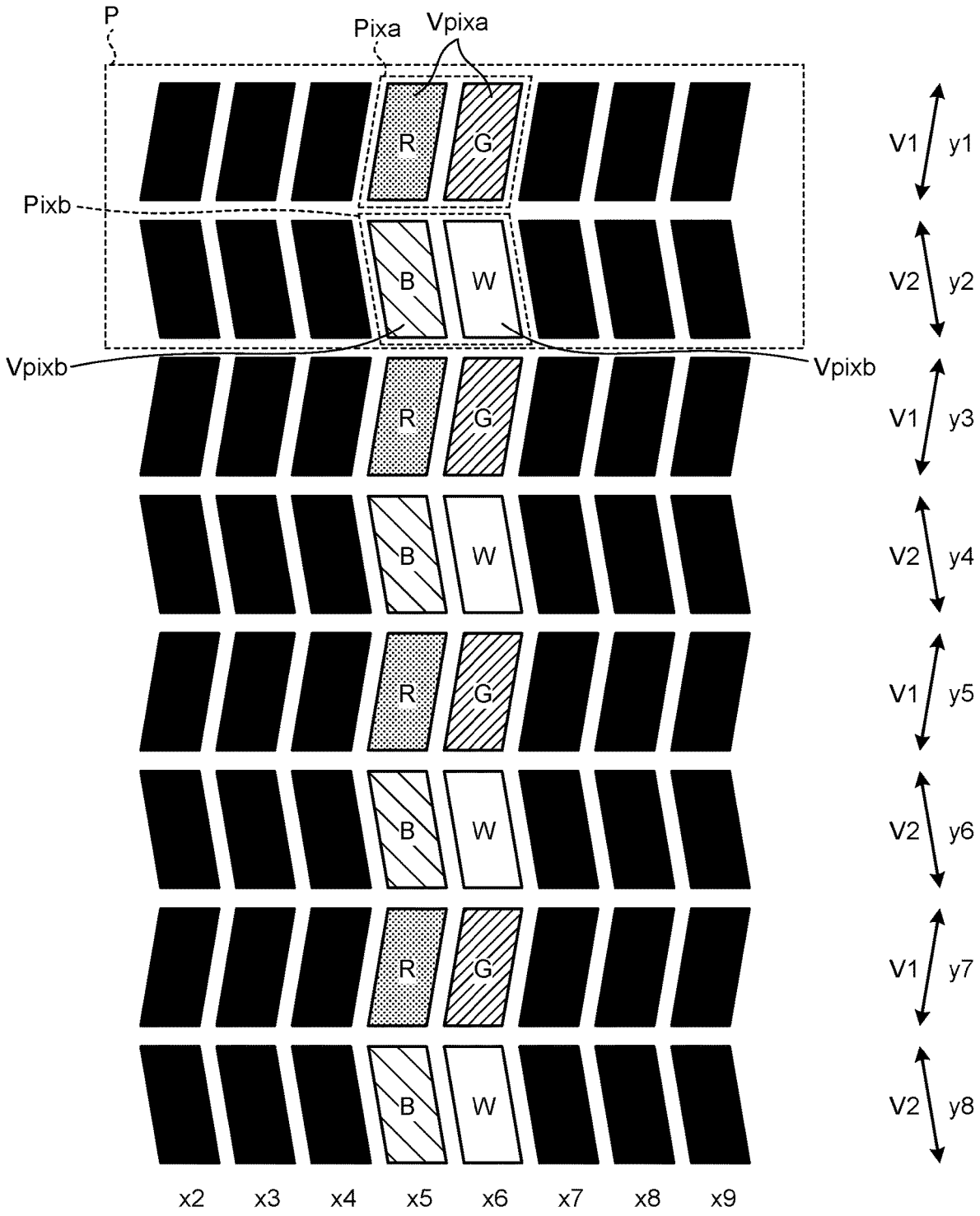
FIG. 13 is a schematic diagram illustrating an example where the display output corresponding to the display pattern in FIG. 9 is performed by the display device in the reference example having the arrangement pattern of pixels and subpixels illustrated by Pattern 1-1 in FIG. 8.
Figure 14:
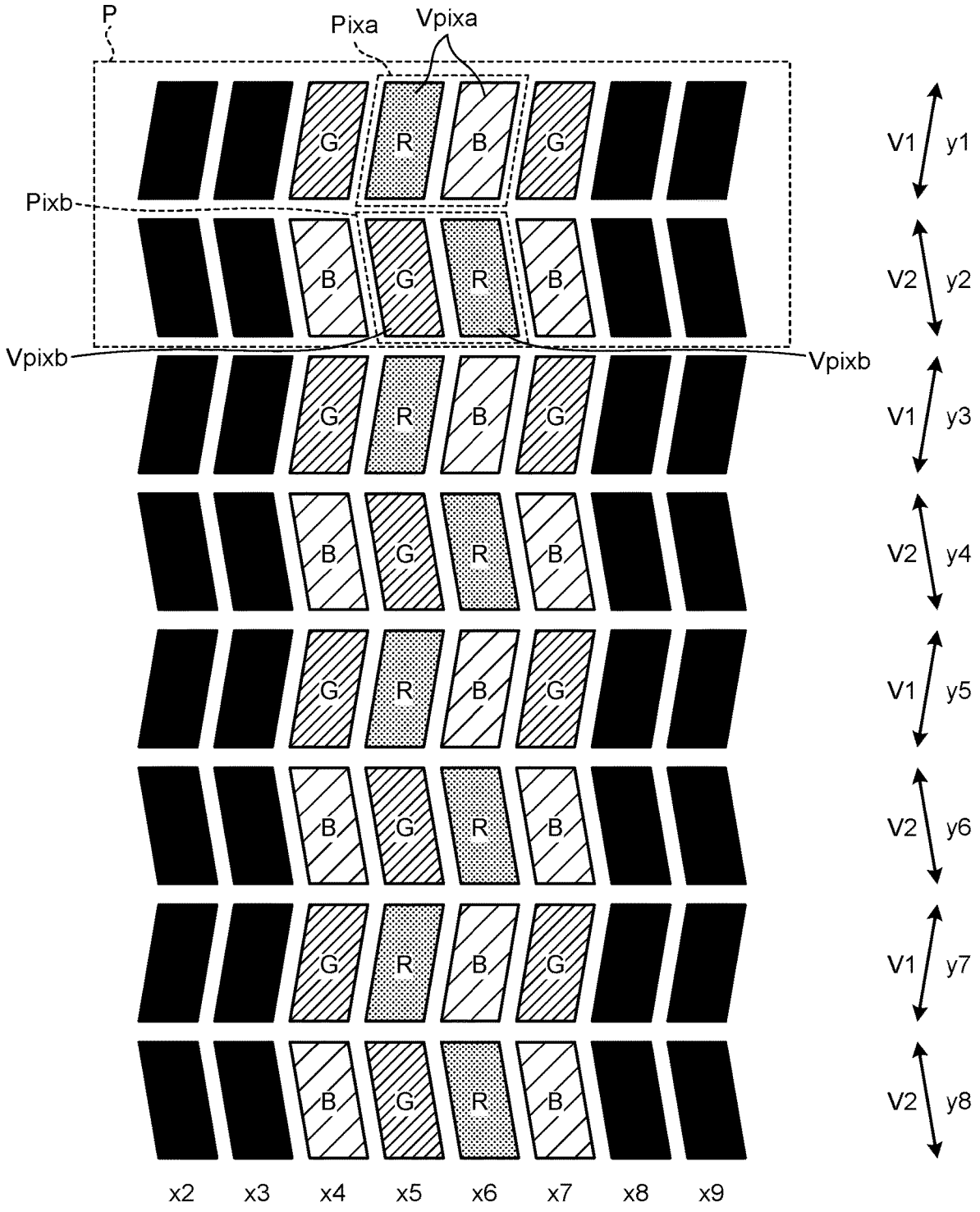
FIG. 14 is a schematic diagram illustrating an example where the display output corresponding to the display pattern in FIG. 9 is performed by the display device in the reference example having the arrangement pattern of pixels and subpixels illustrated by Pattern 1-2 in FIG. 8.

FIG. 13 is a schematic diagram illustrating an example where the display output corresponding to the display pattern in FIG. 9 is performed by the display device in the reference example having the arrangement pattern of pixels Pix and subpixels Vpix illustrated by Pattern 1-1 in FIG. 8. FIG. 14 is a schematic diagram illustrating an example where the display output corresponding to the display pattern in FIG. 9 is performed by the display device in the reference example having the arrangement pattern of pixels Pix and subpixels Vpix illustrated by Pattern 1-2 in FIG. 8. In FIG. 13 and FIG. 14, as with the example illustrated in FIG. 10 and FIG. 11, two subpixels Vpix included in one pixel Pix located at x5 and x6 transmit light with relatively high transmittance. In FIG. 13, as with the example illustrated in FIG. 10, the subpixels Vpix located at x2, x3, x4, x7, x8, and x9 transmit light with relatively low transmittance (or do not transmit light). In FIG. 14, as with the example illustrated in FIG. 10, the subpixels Vpix located at x2, x3, x8, and x9 transmit light with relatively low transmittance (or do not transmit light).

In FIG. 13, among the subpixels Vpix that transmit light with relatively high transmittance in one cycle indicated by a broken line P, the colors of first subpixels Vpixa and the number of the first subpixels Vpixa per color are one each for red (R) and green (G). Among the subpixels Vpix that transmit light with relatively high transmittance in the one cycle indicated by the broken line P, the colors of second subpixels Vpixb and the number of the second subpixels Vpixb per color are one each for blue (B) and white (W).

When one column located at x5 and x6 is a pixel column including RB pixels and GR pixels as illustrated in FIG. 14, among the subpixels Vpix that transmit light with relatively high transmittance in the one cycle indicated by a broken line P, the colors of first subpixels Vpixa and the number of the first subpixels Vpixa per color are one each for red (R) and blue (B). Among the subpixels Vpix that transmit light with relatively high transmittance in one cycle indicated by the broken line P, the colors of second subpixels Vpixb and the number of the second subpixels Vpixb per color are one each for red (R) and green (G). When subpixels Vpix in adjacent pixels are located at x4 and x7 as illustrated in FIG. 14, among the subpixels Vpix that transmit half-reduced light in the one cycle indicated by the broken line P, the colors of first subpixels Vpixa and the number of the first subpixels Vpixa per color are two for green (G). Among the subpixels Vpix that transmit half-reduced light in the one cycle indicated by the broken line P, the colors of second subpixels Vpixb and the number of the second subpixels Vpixb per color are two for blue (B).

According to the reference example in which first subpixels Vpixa and second subpixels Vpixb are alternately arranged in the column direction as described above, the colors of first subpixels Vpixa included in one cycle and the number of the first subpixels Vpixa per color are not the same as those of second subpixels Vpixb included in the one cycle. Thus, in the reference example, display output is recognized with different hues between when seen from the first direction V1 and when seen from the second direction V2. For example, when display output that should be white color such as (R,G,B)=(255,255,255) are seen from the first direction V1, the color of subpixels Vpix whose orientations are closer to the first direction V1 appears more strongly. Similarly, when seen from the second direction V2, the color of subpixels Vpix whose orientations are closer to the second direction V2 appears more strongly. In this manner, in the reference example, unintended coloring may occur depending on the viewing angle. In particular, when Pattern 1-2 is employed as the colors of subpixels Vpix, coloring occurs due to shift of viewing angle gamma of single color.

By contrast, in the first embodiment, the colors of first subpixels Vpixa included in one cycle and the number of the first subpixels Vpixa per color are the same as those of second subpixels Vpixb included in the one cycle. Thus, in the first embodiment, the occurrence of non-uniformity in colors of the subpixels Vpix can be prevented or reduced irrespective of the viewing angle. That is, the coloring, which occurs in the reference example, can be prevented or reduced in the first embodiment. As described above, the first embodiment can more reliably prevent or reduce the occurrence of color shift, which occurs due to the coloring in the reference example.

Employing Pattern 1-1 can set the number of colors of subpixels Vpix to four. In particular, higher luminance can be easily achieved by subpixels Vpix of white (W). Adjacent subpixels that transmit half-reduced light are not necessarily required, and hence the transmittance control of pixels Pix can be more simplified.

Employing Pattern 1-2 can set the number of colors of subpixels Vpix to three. In particular, when the three colors are red (R), green (G), and blue (B), display output based on a general RGB color space can be more easily supported.

Second Embodiment

Next, a display device according to a second embodiment is described. In the description of the display device according to the second embodiment, the same configurations as those in the display device according to the first embodiment are denoted by the same reference numerals and descriptions thereof may be omitted.

Figure 15:
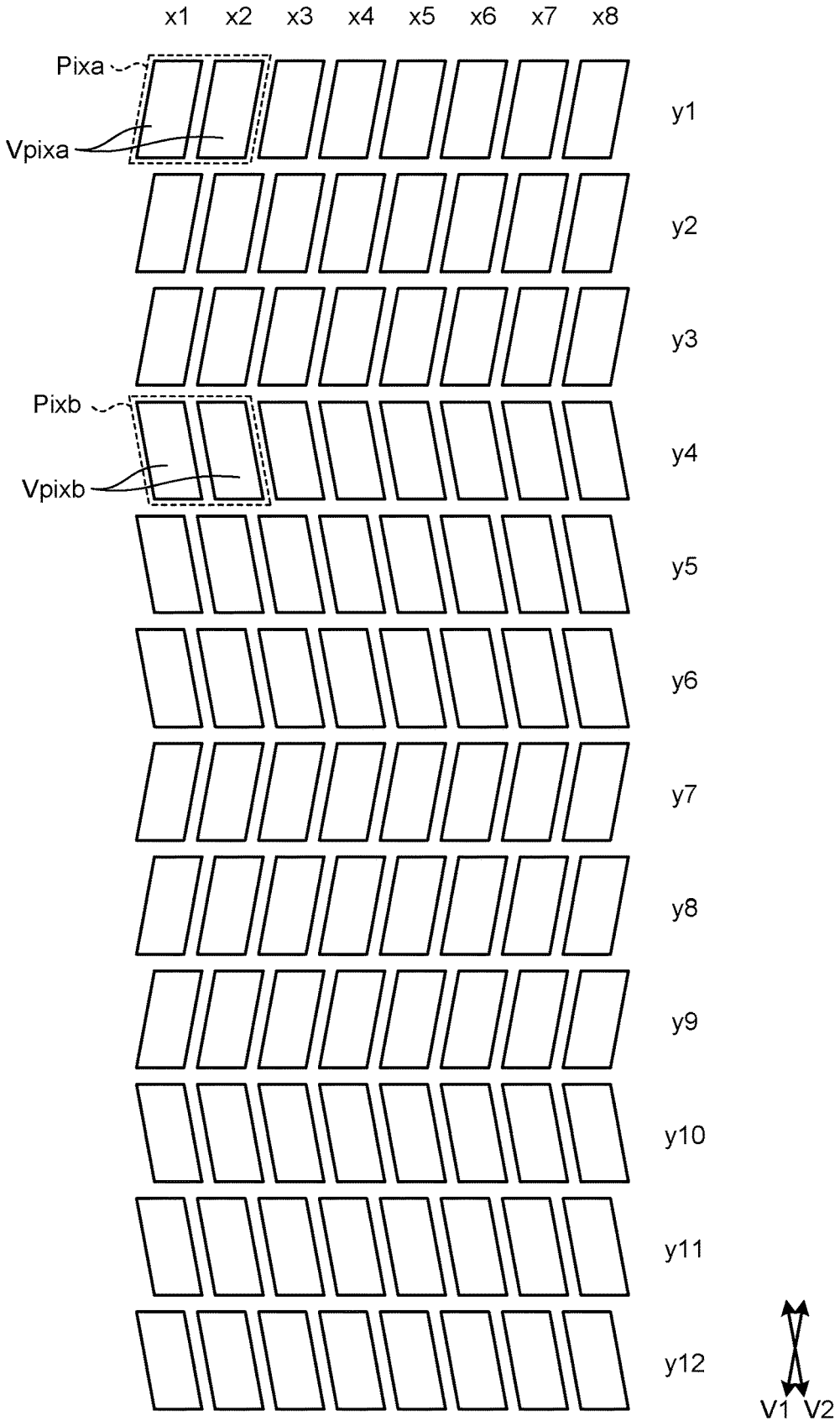
FIG. 15 is a diagram illustrating an arrangement example of first subpixels and second subpixels in a second embodiment.
Figure 17:
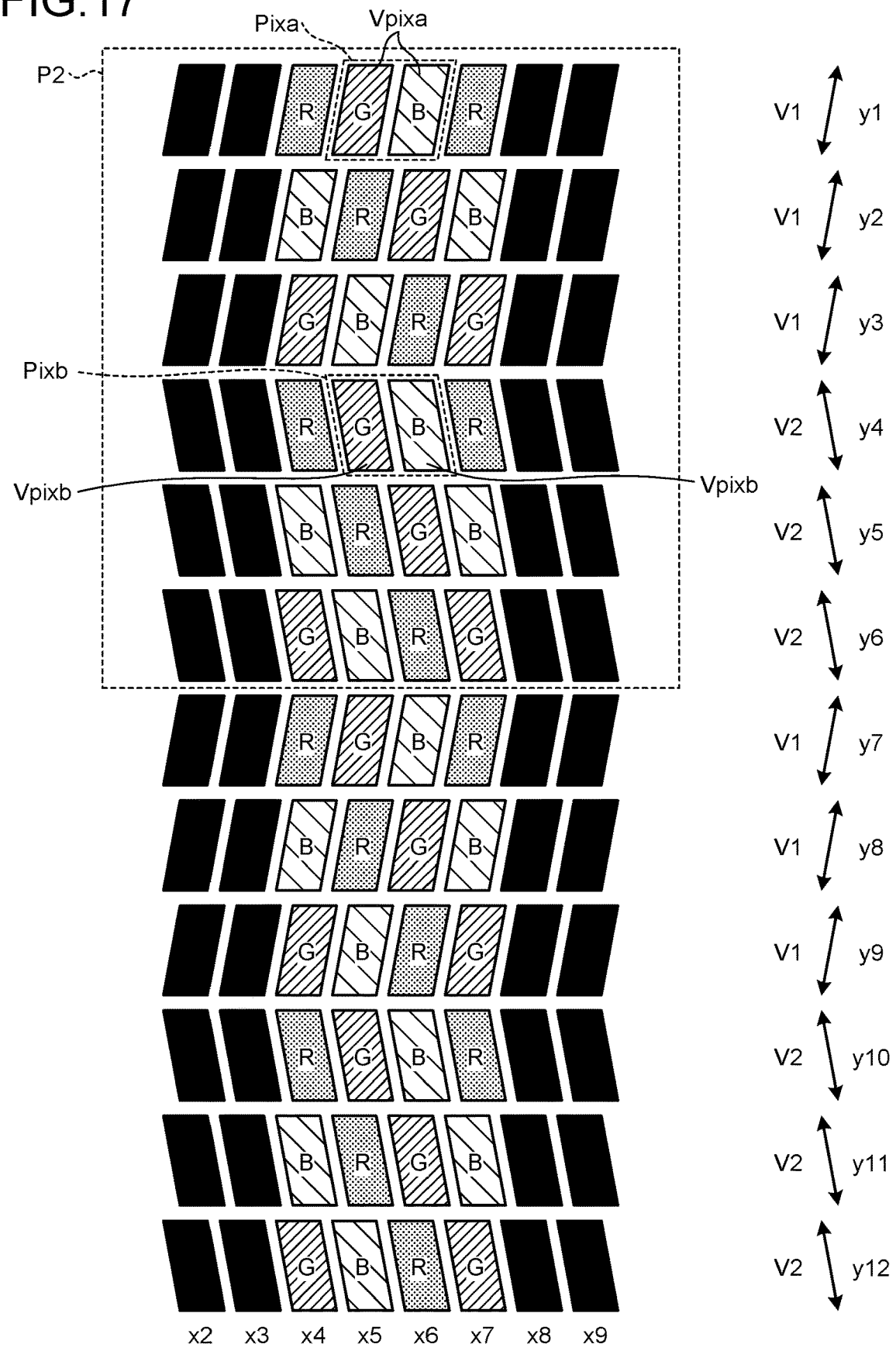
FIG. 17 is a schematic diagram illustrating an example where the display output corresponding to the display pattern in FIG. 9 is performed by the display device in the second embodiment having the arrangement pattern of pixels and subpixels illustrated by Pattern 2-1 in FIG. 16.

FIG. 15 is a diagram illustrating an arrangement example of first subpixels Vpixa and second subpixels Vpixb in the second embodiment. In FIG. 15 and other drawings, x1, x2, x3, x4, x5, x6, x7, and x8 are provided from one end side in the row direction as coordinates representing the positions of eight subpixels Vpix arranged in the row direction among the subpixels Vpix arranged in m rows and n columns. In FIG. 17 and other drawings referred to later, x2, x3, x4, x5, x6, x7, x8, and x9 are provided from one end side in the row direction as coordinates representing the positions of eight subpixels Vpix arranged in the row direction. y1, y2, y3, y4, y5, y6, y7, y8, y9, y10, y11, and y12 are provided from one end side in the column direction as coordinates representing the positions of eight subpixels Vpix arranged in the column direction.

In the second embodiment, for example, as illustrated in FIG. 15, all of the subpixels Vpix located at y1, y2, y3, y7, y8, and y9 are first subpixels Vpixa. All of the subpixels Vpix located at y4, y5, y6, y10, y11, and y12 are second subpixels Vpixb. In this manner, in the example illustrated in FIG. 15, the number of subpixels Vpix in which first subpixels Vpixa and second subpixels Vpixb constitute one cycle in the column direction is 6α. In the example illustrated in FIG. 15, α=1. In the second embodiment, the number of the first subpixels Vpixa that are consecutive and the number of the second subpixel Vpixb that are consecutive, when they are counted from one end side in the column direction within one cycle, are 3β. In the example illustrated in FIG. 15, β=1. β is a natural number.

Figure 16:
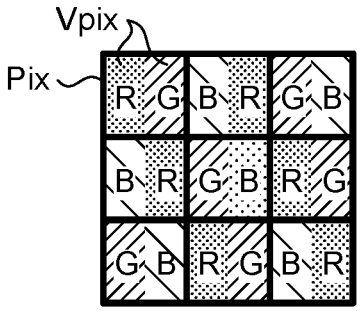
FIG. 16 is a diagram illustrating an arrangement pattern example of pixels and subpixels in the second embodiment.
Figure 16:
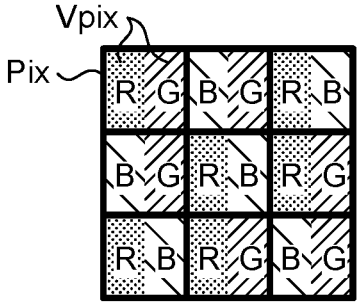

FIG. 16 is a diagram illustrating an arrangement pattern example of pixels Pix and subpixels Vpix in the second embodiment. As with the arrangement example of pixels Pix and subpixels Vpix in Pattern 1-1 and Pattern 1-2 illustrated in FIG. 8, in the arrangement example of pixels Pix and subpixels Vpix in Pattern 2-1 and Pattern 2-2 in FIG. 16, the minimum arrangement unit of pixels Pix and subpixels Vpix is illustrated as a repetition unit in the row direction and the column direction. Specifically, in Pattern 2-1 and Pattern 2-2 illustrated in FIG. 16, the number of subpixels Vpix constituting one color pattern in the column direction is 3α.

Pattern 2-1 in the second embodiment includes, as with Pattern 1-2 in the first embodiment, an RG pixel having a subpixel Vpix of red (R) and a subpixel Vpix of green (G), an BR pixel having a subpixel Vpix of red (R) and a subpixel Vpix of blue (B), and a GB pixel having a subpixel Vpix of green (G) and a subpixel Vpix of blue (B). In Pattern 2-1, the RG pixels, the BR pixels, and the GB pixels are periodically arranged in the row and column directions, and subpixels Vpix of different colors are arranged adjacent to each other in the row and column directions. Specifically, in Pattern 2-1, for example, as illustrated in FIG. 16, a cycle in which an RG pixel, a BR pixel, and a GB pixel are arranged in this order is repeated in the row direction and the column direction, and thereby the following order is obtained: the RG pixel, the BR pixel, the GB pixel, the RG pixel, the BR pixel, the GB pixel, . . . . Thus, subpixels Vpix of different colors are arranged in the row and column directions. In the same manner as the first embodiment, the display device in the second embodiment also performs the subpixel rendering is performed when one pixel Pix has two subpixels Vpix.

Pattern 2-2 in the second embodiment includes, unlike Pattern 2-1, an RG pixel having a subpixel Vpix of red (R) and a subpixel Vpix of green (G), an RB pixel having a subpixel Vpix of red (R) and a subpixel Vpix of blue (B), and a BG pixel having a subpixel Vpix of green (G) and a subpixel Vpix of blue (B). Specifically, for example, the RG pixel has a subpixel Vpix of red (R) located on one end side in the row direction and a subpixel Vpix of green (G) located on the other end side in the row direction. For example, the RB pixel has a subpixel Vpix of red (R) located on one end side in the row direction and a subpixel Vpix of blue (B) located on the other end side in the row direction. For example, the BG pixel has a subpixel Vpix of blue (B) located on one end side in the row direction and a subpixel Vpix of green (G) located on the other end side in the row direction. The colors of subpixels Vpix on one end side and the other end side may be reversed.

In Pattern 2-2, RG pixels, RB pixels, and BG pixels are periodically arranged in the row direction, two subpixels Vpix of one of two colors of red (R), green (G), and blue (B) are arranged consecutively in the column direction, and two subpixels Vpix of the other of the two colors are also arranged consecutively in the column direction. Specifically, in Pattern 2-2, for example, as illustrated in FIG. 16, a cycle in which an RG pixel, a BG pixel, and an RB pixel are arranged in this order is repeated in the row direction and the column direction, and thereby the following order is obtained: the RG pixel, the BG pixel, the RB pixel, the RG pixel, the BG pixel, the RB pixel, . . . . Thus, two subpixels Vpix of red (R) are consecutively arranged in the column direction, and two subpixels of green (G) are consecutively arranged in the column direction.

Figure 18:
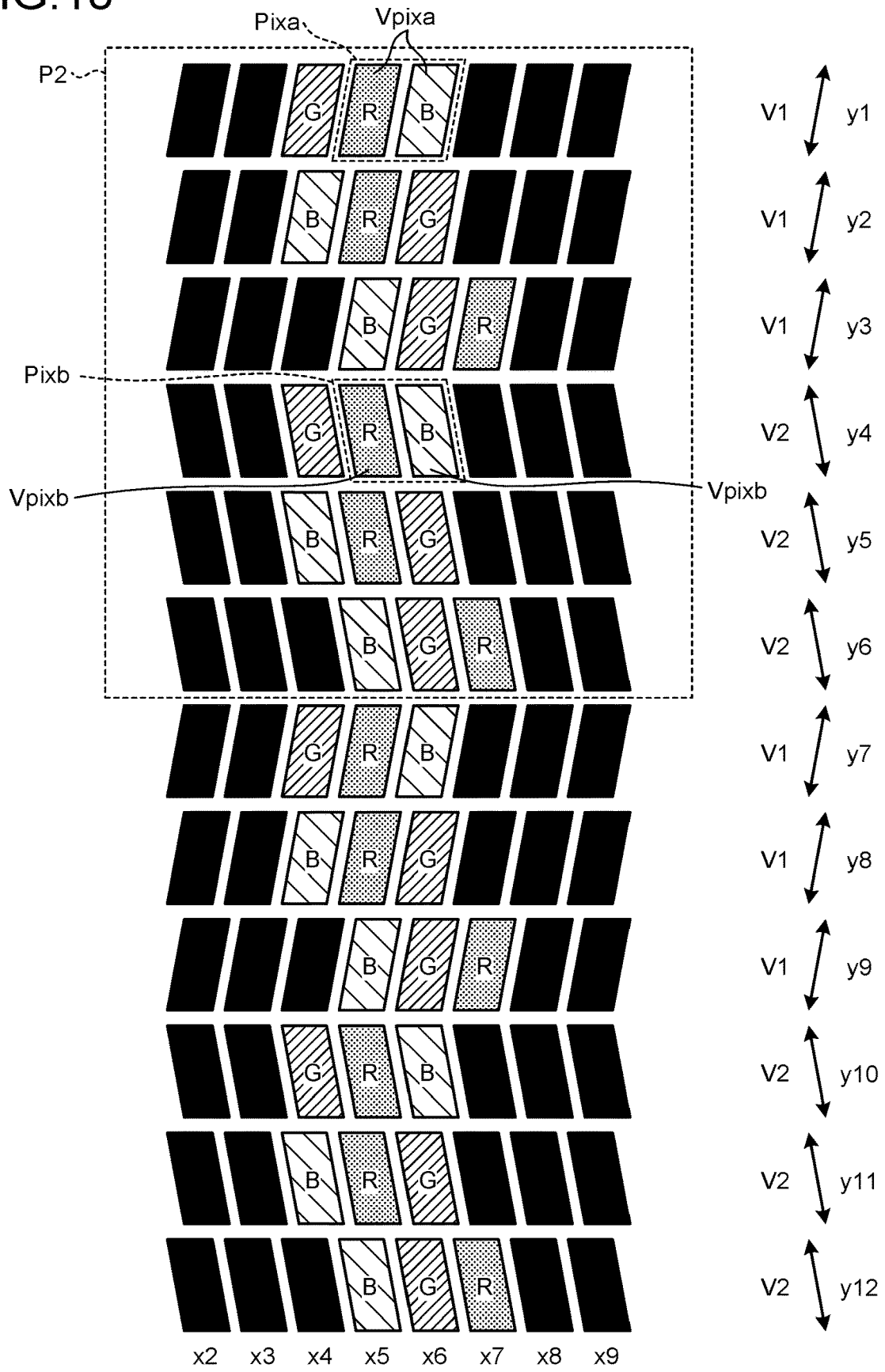
FIG. 18 is a schematic diagram illustrating an example where the display output corresponding to the display pattern in FIG. 9 is performed by the display device in the second embodiment having the arrangement pattern of pixels and subpixels illustrated by Pattern 2-2 in FIG. 16.

FIG. 17 is a schematic diagram illustrating an example where the display output corresponding to the display pattern in FIG. 9 is performed by the display device in the second embodiment having the arrangement pattern of pixels Pix and subpixels Vpix indicated by Pattern 2-1 in FIG. 16. FIG. 18 is a schematic diagram illustrating an example where the display output corresponding to the display pattern in FIG. 9 is performed by the display device in the second embodiment having the arrangement pattern of pixels Pix and subpixels Vpix indicated by Pattern 2-2 in FIG. 16. The light transmittance of each pixel Pix illustrated in FIG. 17 and FIG. 18 is the same as in FIG. 10 and FIG. 11.

In FIG. 17 and FIG. 18, one cycle (six rows) of first subpixels Vpixa and second subpixels Vpixb arranged in the column direction is surrounded by a broken line P2. In FIG. 17 and FIG. 18, among the subpixels Vpix that transmit light with relatively high transmittance in the one cycle, the colors of first subpixels Vpixa and the number of the first subpixels Vpixa per color, are two each for red (R), green (G), and blue (B), and the colors of second subpixels Vpixb and the number of the second subpixels Vpixb per color are the same as those of the first subpixels Vpixa. In FIG. 17, among the subpixels Vpix that transmit half-reduced light in the one cycle, the colors of first subpixels Vpixa and the number of the first subpixels Vpixa per color are two each for red (R), green (G), and blue (B), and the colors of second subpixels Vpixb and the number of the second subpixels Vpixb per color are the same as those of the first subpixels Vpixa. In FIG. 18, among the subpixels Vpix that transmit half-reduced light in the one cycle, the colors of first subpixels Vpixa and the number of the first subpixels Vpixa per color are one each for red (R), green (G), and blue (B), and the colors of second subpixels Vpixb and the number of the second subpixels Vpixb per color are the same as those of the first subpixels Vpixa.

As described above, according to the second embodiment in which Pattern 2-1 and Pattern 2-2 are employed, the colors of first subpixels Vpixa included in one cycle and the number of the first subpixels Vpixa per color are the same as those of second subpixels Vpixb included in the one cycle. This uniformity is established both within one column (see FIG. 3) and within two or more columns.

The display device according to the second embodiment is the same as the display device according to the first embodiment except for the notable features described above.

As with the first embodiment, according to the second embodiment, the colors of first subpixels Vpixa included in one cycle and the number of the first subpixels Vpixa per color are the same as those of second subpixels Vpixb included in the one cycle. Coloring, which occurs in the reference example, can thus be prevented or reduced in the second embodiment. As described above, the second embodiment can more reliably reduce or prevent the occurrence of color shift, which occurs due to the coloring in the reference example.

Employing Pattern 2-1 or Pattern 2-2 can set the number of colors of subpixels Vpix to three. In particular, when the three colors are red (R), green (G), and blue (B), display output based on a general RGB color space can be more easily supported. Employing Pattern 2-1 can prevent the subpixels Vpix of the same color from being arranged consecutively in the column direction. Employing Pattern 2-2 can prevent the subpixels Vpix of the same color from being arranged consecutively in the oblique direction for all three colors.

Pattern 2-1 described above with reference to FIG. 16 can be used in combination with the arrangement of first subpixels Vpixa and second subpixels Vpixb in the first embodiment described above with reference to FIG. 7. In this case, $\alpha=2$ (12-row cycle).

Figure 19:
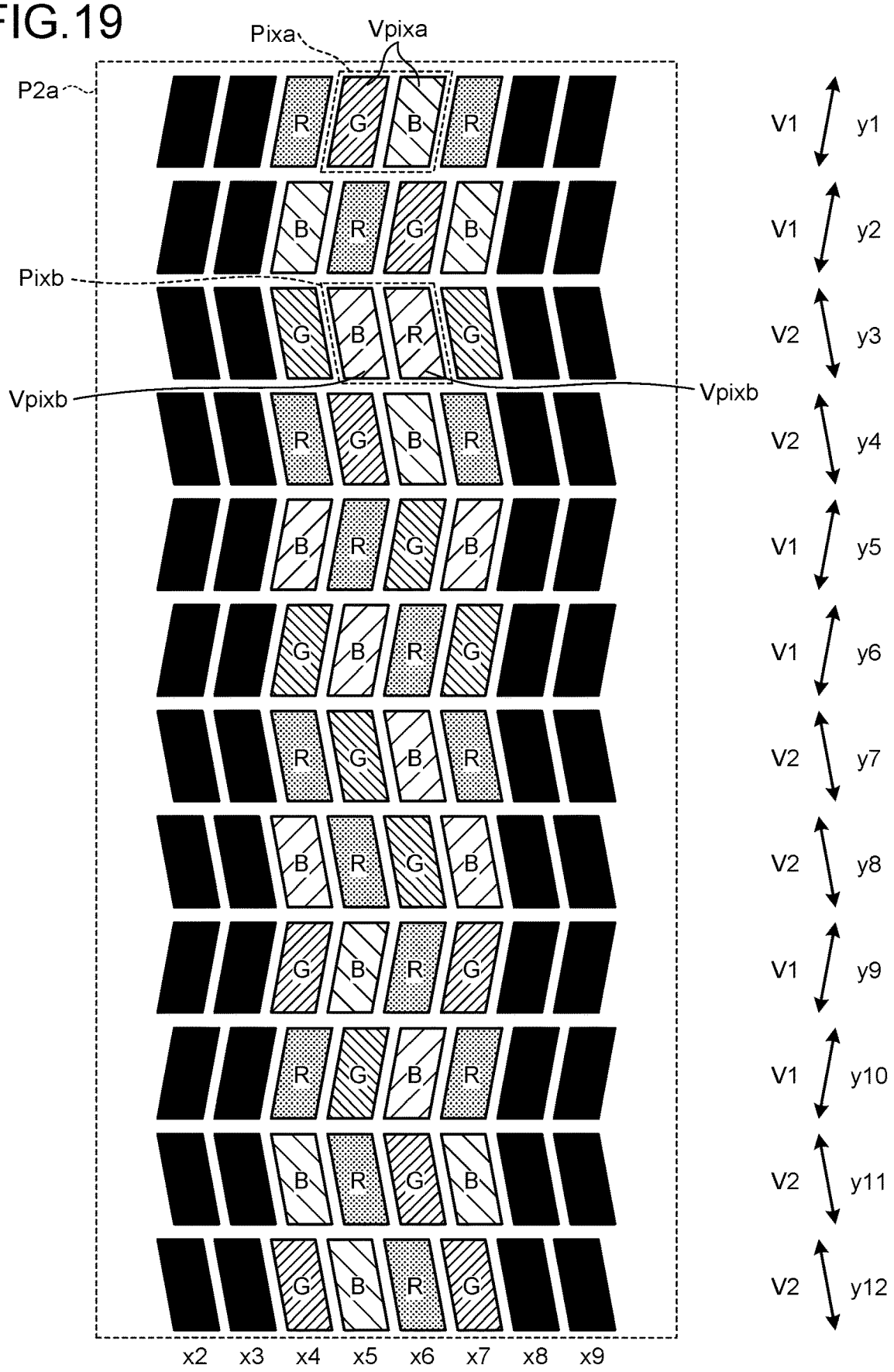
FIG. 19 is a schematic diagram illustrating an example where the display output corresponding to the display pattern in FIG. 9 is performed by the display device in the first embodiment having the arrangement pattern of pixels and subpixels illustrated by Pattern 2-1 in FIG. 16.

FIG. 19 is a schematic diagram illustrating an example where the display output corresponding to the display pattern in FIG. 9 is performed by the display device in the first embodiment having the arrangement pattern of pixels Pix and subpixels Vpix indicated by Pattern 2-1 in FIG. 16. In FIG. 19, one cycle (12 rows) of first subpixels Vpixa and second subpixels Vpixb arranged in the column direction is surrounded by a broken line P2*a*. In FIG. 19, among the subpixels Vpix that transmit light with relatively high transmittance in the one cycle, the colors of first subpixels Vpixa and the number of the first subpixels Vpixa per color are four each for red (R), green (G), and blue (B), and the color of second subpixels Vpixb and the number of the second subpixels Vpixb per color are the same as those of the first subpixels Vpixa. In FIG. 19, among the subpixels Vpix that transmit half-reduced light in the one cycle, the colors of first subpixels Vpixa and the number of the first subpixels Vpixa per color are four each for red (R), green (G), and blue (B), and the colors of second subpixels Vpixb and the number of the second subpixels Vpixb per color are the same as those of the first subpixels Vpixa.

As described above, according to the first embodiment in which Pattern 2-1 is employed, the colors of first subpixels Vpixa included in one cycle and the number of the first subpixels Vpixa per color are the same as those of second subpixels Vpixb included in the one cycle. This uniformity is established both within one column (see FIG. 3) and within two or more columns. Thus, also in the example illustrated in FIG. 19, the occurrence of color shift can be more reliably reduced or prevented.

Figure 20:
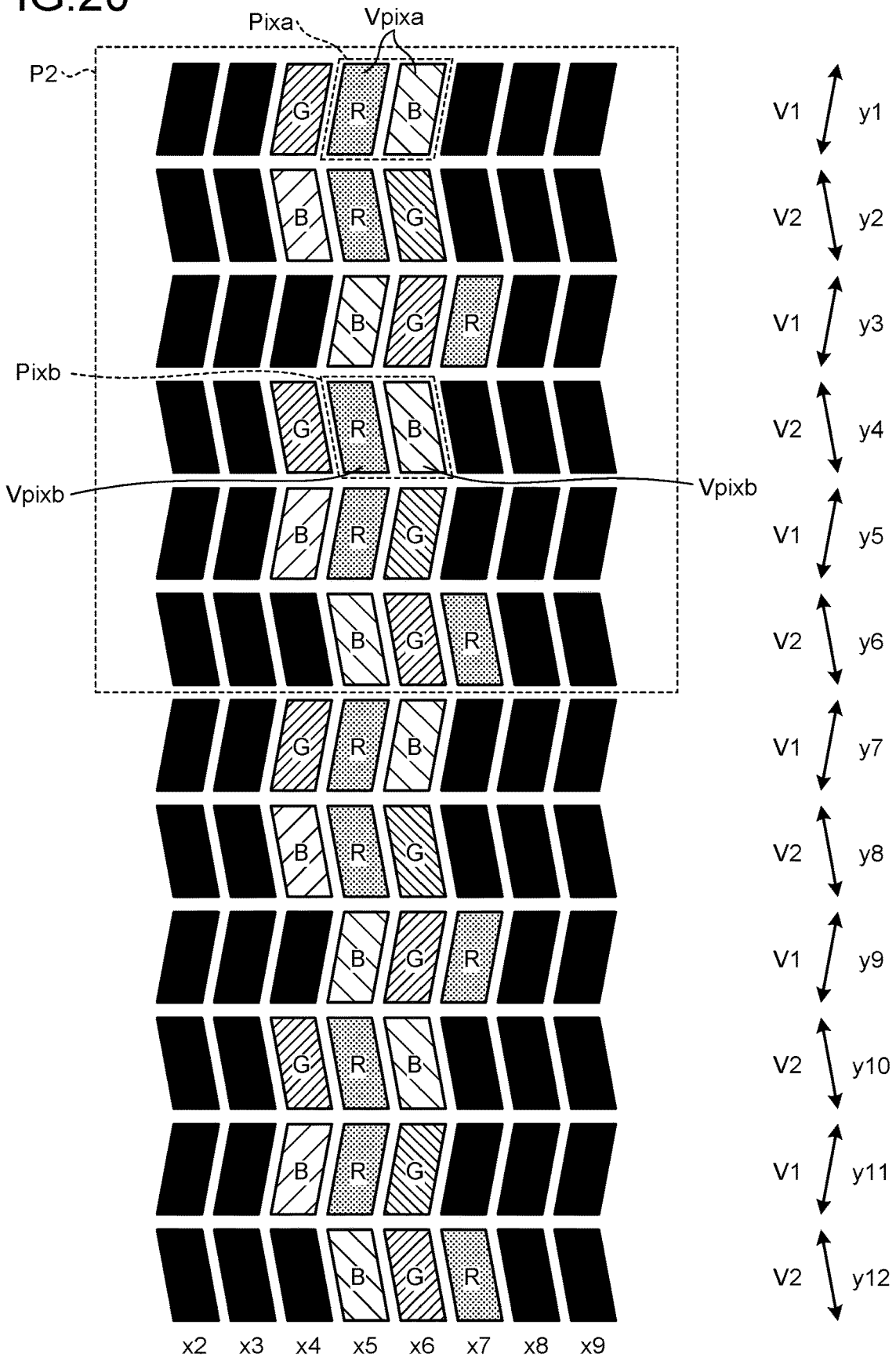
FIG. 20 is a schematic diagram illustrating an example where the display output corresponding to the display pattern in FIG. 9 is performed by the display device in the second embodiment that has the arrangement pattern of pixels and subpixels indicated by Pattern 2-2 in FIG. 16 and that employs the arrangement example of first subpixels and second subpixels illustrated in FIG. 12.

FIG. 20 is a schematic diagram illustrating an example where the display output corresponding to the display pattern in FIG. 9 is performed by the display device in the second embodiment which has the arrangement pattern of pixels and subpixels indicated by Pattern 2-2 in FIG. 16 and which employs the arrangement example of first subpixels and second subpixels illustrated in FIG. 12. For example, as illustrated in FIG. 20, Pattern 2-2 can be used in combination with the arrangement of first subpixels Vpixa and second subpixels Vpixb described above with reference to FIG. 12. In this case, the number of subpixels Vpix constituting one color pattern in the column direction is $3\alpha$. In this case, the number of subpixels Vpix in which first subpixels Vpixa and second subpixels Vpixb constitute one cycle in the column direction is $6\alpha$. In this case, the number of the first subpixels Vpixa that are consecutive and the number of the second subpixels Vpixb that are consecutive, when they are counted from one end side in the column direction within one cycle, are numbers (for example, 1) smaller than $3\beta$. In this case, among the subpixels Vpix that transmit light with relatively high transmittance in one cycle, the of colors of first subpixels Vpixa and the number of the first subpixels Vpixa per color are $2\alpha$ each for red (R), green (G), and blue (B), and the colors of second subpixels Vpixb and the number of the second subpixels Vpixb per color are the same as those of the first subpixel Vpixa. Among the subpixels Vpix that transmit half-reduced light in the one cycle, the colors of first subpixels Vpixa and the number of the first subpixels Vpixa per color are $2\alpha$ each for red (R), green (G), and blue (B), and the colors of second subpixels Vpixb and the number of the second subpixels Vpixb per color are the same as those of the first subpixel Vpixa.

Third Embodiment

Next, a display device according to a third embodiment is described. In the description of the display device according to the third embodiment, the same configurations as in the display device according to the first embodiment are denoted by the same reference numerals, and descriptions thereof may be omitted.

Figure 21:
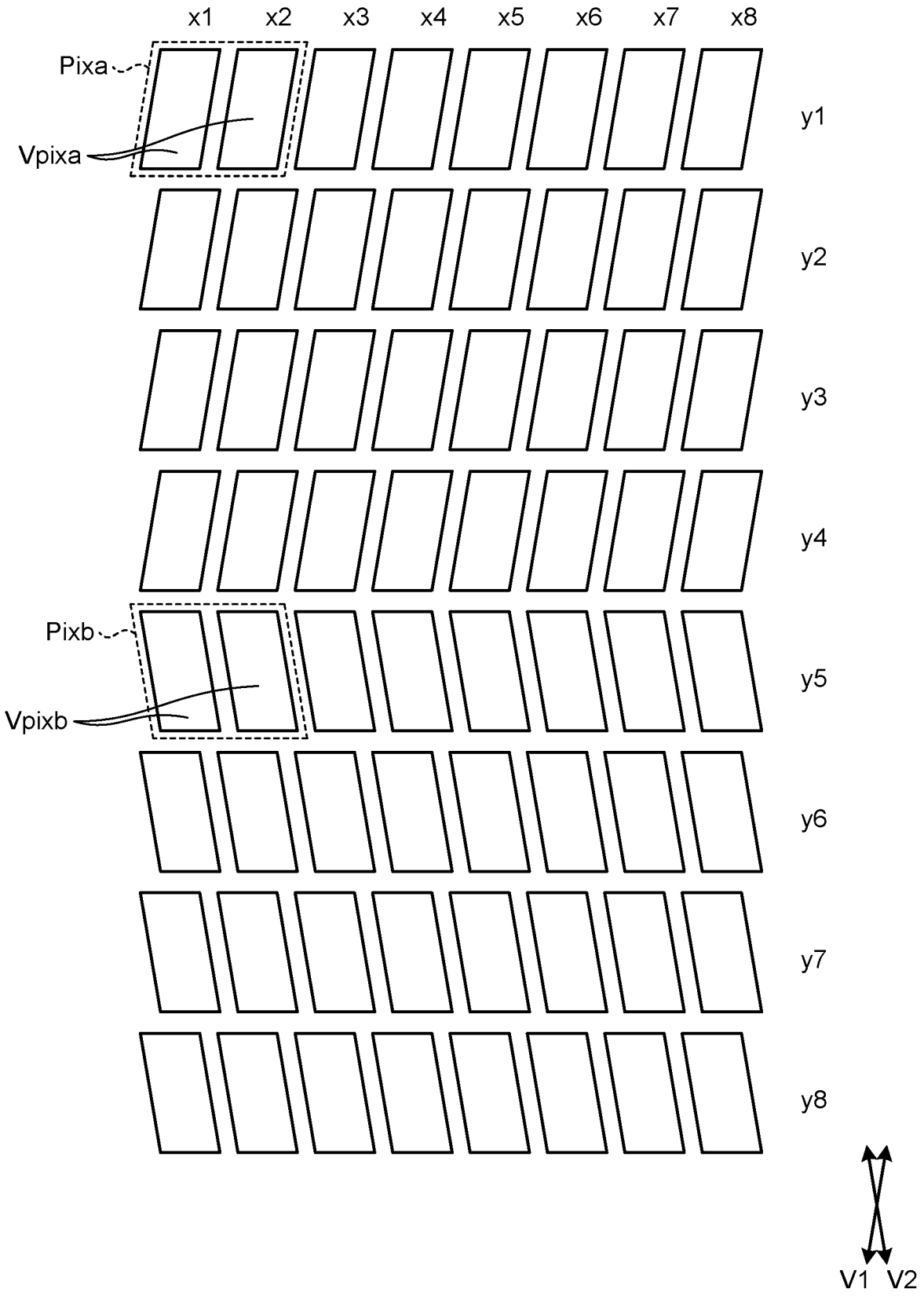
FIG. 21 is a diagram illustrating an arrangement example of first subpixels and second subpixels in a third embodiment.
Figure 22:
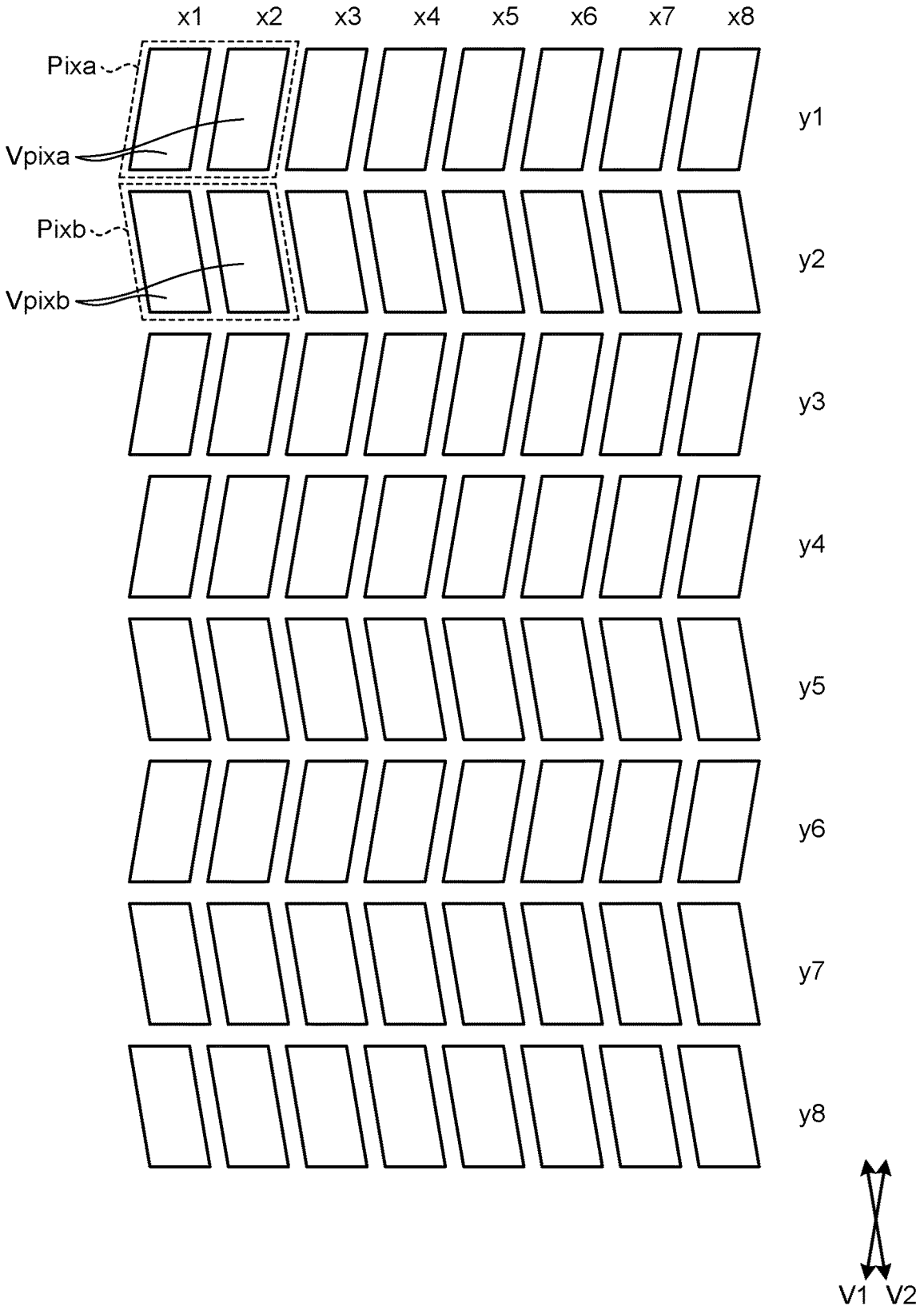
FIG. 22 is a diagram illustrating another arrangement example of first subpixels and second subpixels in the third embodiment.
Figure 24:
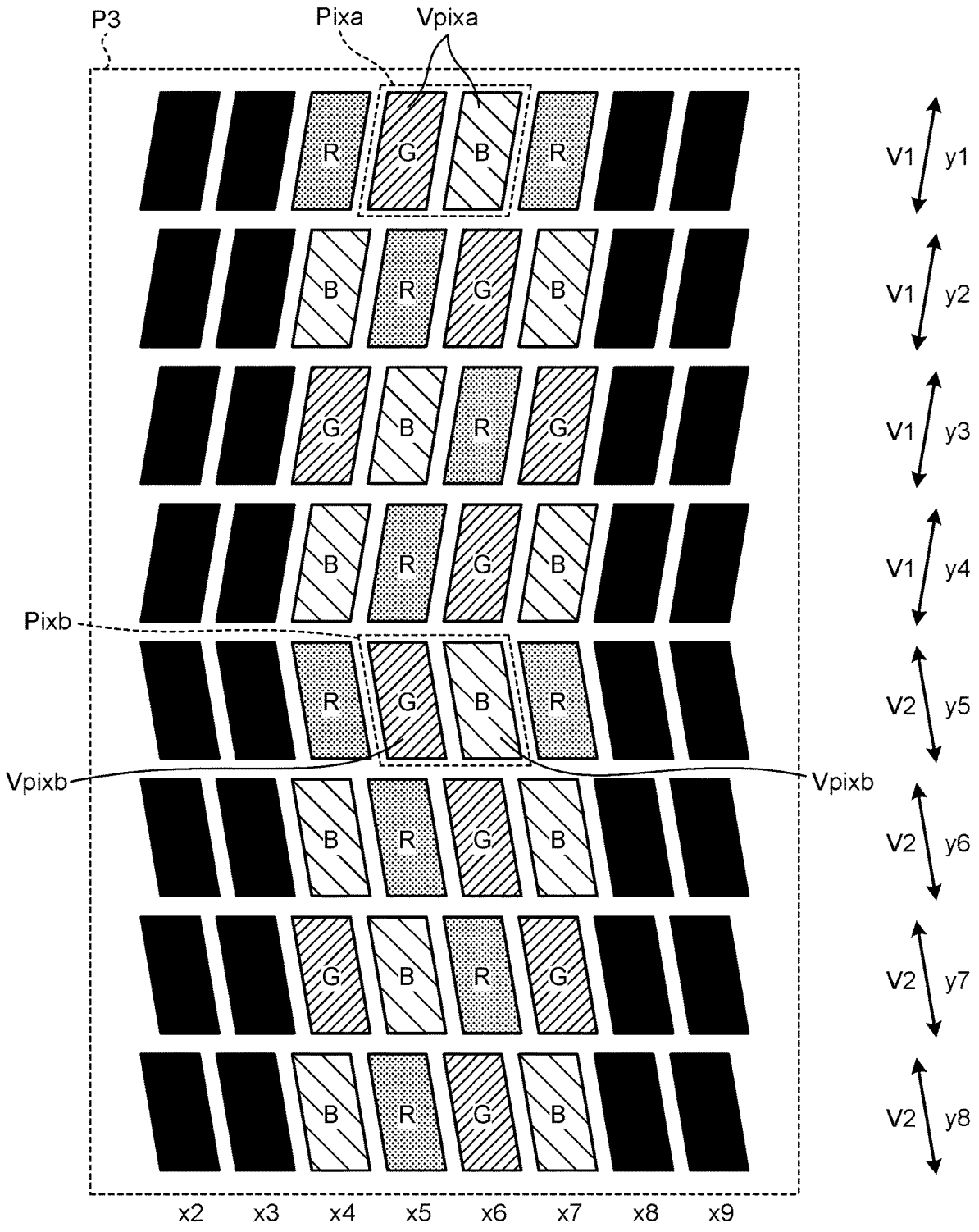
FIG. 24 is a schematic diagram illustrating an example where the display output corresponding to the display pattern in FIG. 9 is performed by an example (FIG. 21) of a display device in the third embodiment having the arrangement pattern of pixels and subpixels illustrated by Pattern 3 in FIG. 23.

FIG. 21 is a diagram illustrating an arrangement example of first subpixels Vpixa and second subpixels Vpixb in the third embodiment. FIG. 22 is a diagram illustrating another arrangement example of first subpixels Vpixa and second subpixels Vpixb in the third embodiment. In FIG. 21 and other drawings, x1, x2, x3, x4, x5, x6, x7, and x8 are provided from one end side in the row direction as coordinates representing the positions of eight subpixels Vpix arranged in the row direction among the subpixels Vpix arranged in m rows and n columns. In FIG. 24 and other drawings referred to later, x2, x3, x4, x5, x6, x7, x8, and x9 are provided from one end side in the row direction as coordinates representing the positions of eight subpixels Vpix arranged in the row direction. y1, y2, y3, y4, y5, y6, y7, and y8 are provided from one end side in the column direction as coordinates representing the positions of eight subpixels Vpix arranged in the column direction.

In the example illustrated in FIG. 21, all of the subpixels Vpix located at y1, y2, y3, and y4 are first subpixels Vpixa, and all of the subpixels Vpix located at y5, y6, y7, and y8 are second subpixels Vpixb. In the example illustrated in FIG. 22, all of the subpixels Vpix located at y1, y3, y4, and y6 are first subpixels Vpixa, and all of the subpixels Vpix located at y2, y5, y7, and y8 are second subpixels Vpixb. Thus, in the examples illustrated in FIG. 21 and FIG. 22, as with the first embodiment, the number of subpixels Vpix in which first subpixels Vpixa and second subpixels Vpixb constitute one cycle in the column direction is $4\alpha$. In the examples illustrated in FIG. 21 and FIG. 22, $\alpha=2$ (8-row cycle).

In the third embodiment, as with the first embodiment, the number of the first subpixels Vpixa that are consecutive and the number of the second subpixels Vpixb that are consecutive, when they are counted from one end side in the column direction within one cycle, are equal to each other. Specifically, in the example illustrated in FIG. 21, the number of the consecutive first subpixels Vpixa and the number of the consecutive second subpixels Vpixb are 4. In the example illustrated in FIG. 22, the number of the consecutive first subpixels Vpixa and the number of the consecutive second subpixels Vpixb are 2 (or 1).

Figure 23:
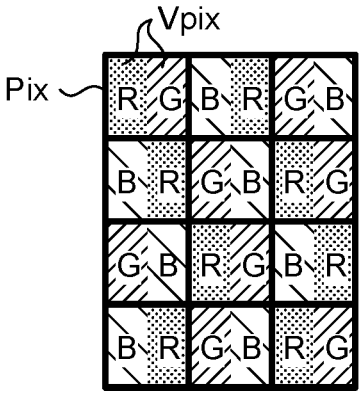
FIG. 23 is a diagram illustrating an arrangement pattern example of pixels and subpixels in the third embodiment.

FIG. 23 is a diagram illustrating an arrangement pattern example of pixels Pix and subpixels Vpix in the third embodiment. As with the arrangement example of pixels Pix and subpixels Vpix in Pattern 1-1 illustrated in FIG. 8, in the arrangement example of pixels Pix and subpixels Vpix in Pattern 3 illustrated in FIG. 23, the minimum arrangement unit of pixels Pix and subpixels Vpix is illustrated as a repetition unit in the row direction and the column direction. Specifically, in Pattern 3 illustrated in FIG. 23, the number of subpixels Vpix constituting one color pattern in the column direction is $2\alpha$. $\alpha$ is a natural number.

Pattern 3 in the third embodiment includes RG pixels, BR pixels, and GB pixels as with Pattern 1-2 in the first embodiment. In Pattern 3, the RG pixels, the BR pixels, and the GB pixels are periodically arranged in the row direction. In Pattern 3, the RG pixels, the BR pixels, and the GB pixels are periodically arranged in the column direction such that two pixels Pix among the RG pixel, the BR pixel, and the GB pixel sandwich the remaining one pixel Pix. Specifically, in Pattern 3, for example, as illustrated in FIG. 23, a cycle in which an RG pixel, a BR pixel, and a GB pixel are arranged in this order is repeated in the row direction, and thereby the following order is obtained: the RG pixel, the BR pixel, the GB pixel, the RG pixel, the BR pixel, the GB pixel, . . . . Thus, the subpixels Vpix of different colors are arranged adjacent to each other in the row direction. In the example illustrated in FIG. 23, the arrangements of pixels Pix in pixel rows in even-numbered columns counted from one end side in the column direction are the same. This configuration forms the periodicity in which two pixels Pix among an RG pixel, a BR pixel, and a GB pixel arranged in pixel rows in odd-numbered columns sandwich the remaining one pixel Pix, with pixels Pix of pixel rows in even-numbered columns as "remaining one pixel Pix". In the same manner as the first and second embodiments, the display device in the third embodiment also performs the subpixel rendering when one pixel Pix has two subpixels Vpix.

Figure 25:
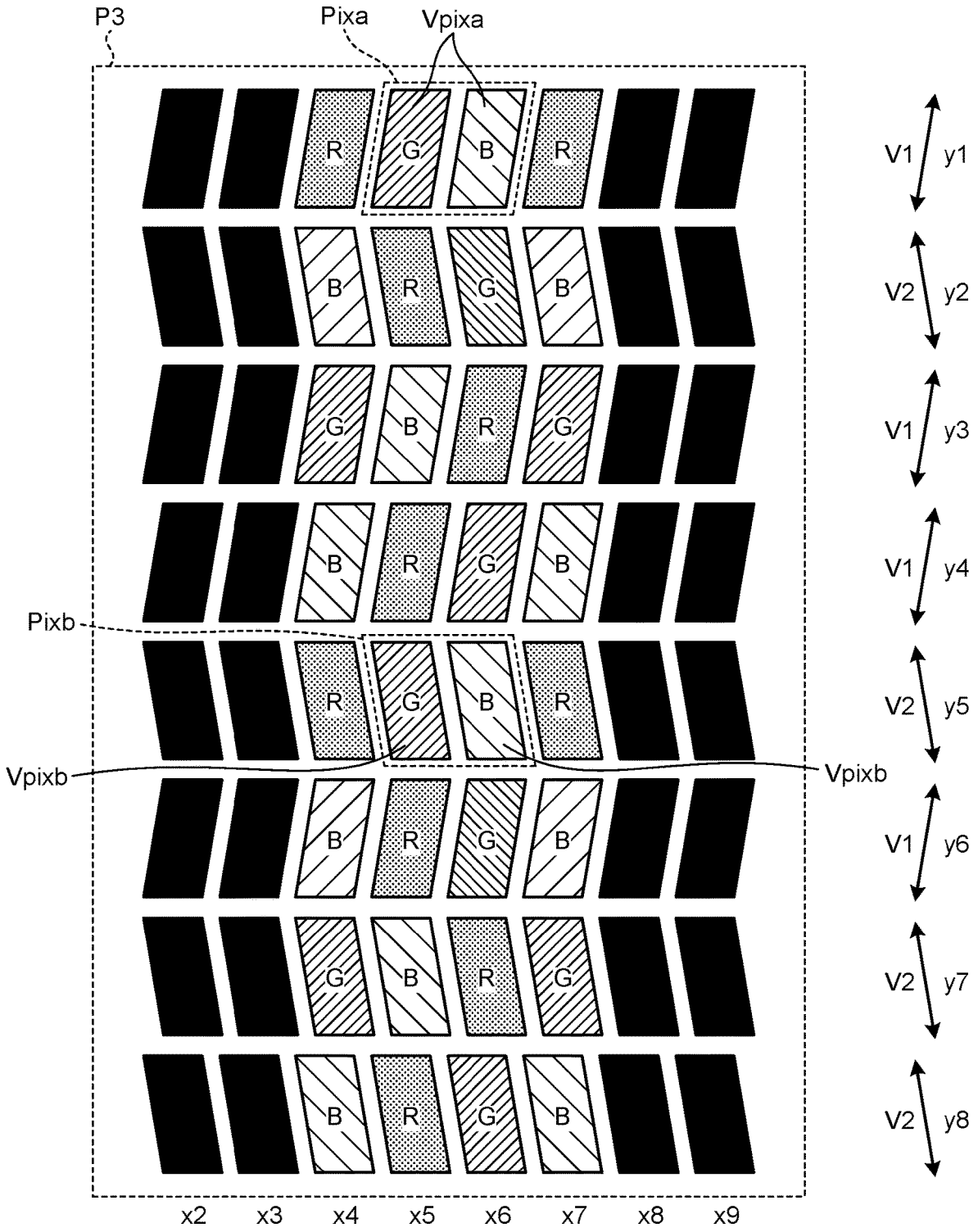
FIG. 25 is a schematic diagram illustrating an example where the display output corresponding to the display pattern in FIG. 9 is performed by another example (FIG. 22) of a display device in the third embodiment having the arrangement pattern of pixels and subpixels illustrated by Pattern 3 in FIG. 23.

FIG. 24 is a schematic diagram illustrating an example where the display output corresponding to the display pattern in FIG. 9 is performed by an example (FIG. 21) of the display device in the third embodiment having the arrangement pattern of pixels Pix and subpixels Vpix illustrated by Pattern 3 in FIG. 23. FIG. 25 is a schematic diagram illustrating an example where the display output corresponding to the display pattern in FIG. 9 is performed by another example (FIG. 22) of a display device in the third embodiment having the arrangement pattern of pixels Pix and subpixels Vpix illustrated by Pattern 3 in FIG. 23. The transmittance of light of each pixel Pix illustrated in FIG. 24 and FIG. 25 is the same as that in FIG. 10 and FIG. 11.

In FIG. 24 and FIG. 25, one cycle (eight rows) of first subpixels Vpixa and second subpixels Vpixb arranged in the column direction are surrounded by a broken line P3. As illustrated in FIG. 24 and FIG. 25, when the pixels Pix located at x5 and x6 in pixel rows in even-numbered columns counted from one end side in the column direction are RG pixels, among the subpixels Vpix that transmit light with relatively high transmittance in the one cycle, the colors of first subpixels Vpixa and the number of the first subpixels Vpixa per color are three each for red (R) and green (G) and two for blue (B), and the color of second subpixels Vpixb and the number of the second subpixels Vpixb per color are the same as those of the first subpixels Vpixa. In this case, among the subpixels Vpix that transmit half-reduced light in the one cycle, the colors of first subpixels Vpixa and the number of the first subpixels Vpixa per color are two each for red (R) and green (G) and four for blue (B), and the colors of second subpixels Vpixb and the number of the second subpixels Vpixb per color are the same as those of the first subpixels Vpixa.

Although not illustrated, when the pixels Pix located at x5 and x6 in pixel rows in even-numbered columns counted from one end side in the column direction are BR pixels, among the subpixels Vpix that transmit light with relatively high transmittance in the one cycle, the colors of first subpixels Vpixa and the number of the first subpixels Vpixa per color are three each for red (R) and blue (B) and two for green (G), and the color of second subpixels Vpixb and the number of the second subpixels Vpixb per color are the same as those of the first subpixels Vpixa. In this case, among the subpixels Vpix that transmit half-reduced light in the one cycle, the colors of first subpixels Vpixa and the number of the first subpixels Vpixa per color are two each for red (R) and blue (B) and four for green (G), and the color of second subpixels Vpixb and the number of the second subpixels Vpixb per color are the same as those of the first subpixels Vpixa. When the pixels Pix located at x5 and x6 in pixel rows in even-numbered columns counted from one end side in the column direction are GB pixels, among the subpixels Vpix that transmit light with relatively high transmittance in the one cycle, the colors of first subpixels Vpixa and the number of the first subpixels Vpixa per color are three each for green (G) and blue (B) and two for red (R), and the color of second subpixels Vpixb and the number of the second subpixels Vpixb per color are the same as those of the first subpixels Vpixa. In this case, among the subpixels Vpix that transmit half-reduced light in the one cycle, the colors of first subpixels Vpixa and the number of the first subpixels Vpixa per color are two each for green (G) and blue (B) and four for red (R), and the colors of second subpixels Vpixb and the number of the second subpixels Vpixb per color are the same as those of the first subpixels Vpixa.

As described above, according to the third embodiment in which Pattern 3 is employed, the colors of first subpixels Vpixa included in one cycle and the number of the first subpixels Vpixa per color are the same as those of second subpixels Vpixb included in the one cycle. This uniformity is established both within one column (see FIG. 3) and within two or more columns.

The display device according to the third embodiment is the same as the display device according to the first embodiment except for the notable features described above.

According to the third embodiment, as with the first embodiment, the colors of first subpixels Vpixa included in one cycle and the number of the first subpixels Vpixa per color are the same as those of second subpixels Vpixb included in the one cycle. Coloring, which occurs in the reference example, can thus be prevented or reduced in the third embodiment. As described above, the third embodiment can more reliably reduce or prevent the occurrence of color shift, which occurs due to the coloring in the reference example.

Employing Pattern 3 can set the number of colors of subpixels Vpix to three. In particular, when the three colors are red (R), green (G), and blue (B), display output based on a general RGB color space can be more easily supported. Employing Pattern 3 can prevent subpixels Vpix of the same colors from being arranged consecutively in the column direction.

$\alpha$ is not limited to 1 or 2. $\beta$ is not limited to 1. $\alpha$ and $\beta$ only need to be natural numbers.

The relation between the row direction and the column direction in the description of the embodiments is merely an example of one direction and the other direction. The relation is not limited thereto, and may be reversed.

In the embodiments, red (R), green (G), blue (B), and white (W) are exemplified as the first color, the second color, the third color, and the fourth color. However, the first color, the second color, the third color, and the fourth color are not limited to the exemplified colors, and can be changed as appropriate. For example, the first color, the second color, and the third color may be cyan (C), magenta (M), and yellow (Y). Yellow (Y) may be employed as a fourth color that can be combined with the first color, the second color, and the third color of red (R), green (G), and blue (B).

It should be understood that other functions and effects obtained from the embodiments that are apparent from the description in the specification and that could be conceived by a person skilled in the art as appropriate are exhibited by the present invention.

What is claimed is:

1. A display device comprising a display unit having a display surface on which a plurality of pixels are arranged in row and column directions, wherein each of the pixels includes a plurality of subpixels having different colors, subpixels included in the pixels include a first subpixel and a second subpixel, the first subpixel including an electrode having an opening with a longitudinal direction along a first direction, the second subpixel including an electrode having an opening with a longitudinal direction along a second direction, the first direction and the second direction are directions along the display surface and are different from the row and column directions, the longitudinal directions of the openings of all of the subpixels that are arranged in a third direction are identical, the number of subpixels constituting one color pattern in a fourth direction is $2\alpha$, the number of subpixels in which the first subpixels and the second subpixels arranged in the fourth direction constitute one cycle is $4\alpha$, at least two of the first subpixels, having the first direction, are consecutively arranged in the fourth direction, at least two of the second subpixels, having the second direction, are consecutively arranged in the fourth direction, the third direction is one of the row and column directions, and the fourth direction is the other direction of the row and column directions, the number of the first subpixels with odd numbers, the number of the first subpixels with even numbers, the number of the second subpixels with odd numbers, and the number of the second subpixels with even numbers when counted from one end side in the fourth direction within the one cycle are equal to one another, and $\alpha$ is a natural number.

2. The display device according to claim 1, wherein each of the pixels includes two subpixels arranged in the third direction, the pixels include a first pixel and a second pixel, the first pixel having a subpixel of a first color and a subpixel of a second color, and the second pixel having a subpixel of a third color and a subpixel of a fourth color, and the first pixel and the second pixel are arranged alternately along the row and column directions.

3. The display device according to claim 1, wherein each of the pixels includes two subpixels arranged in the third direction, the pixels include a first pixel, a second pixel, and a third pixel, the first pixel having a subpixel of a first color and a subpixel of a second color, the second pixel having a subpixel of the first color and a subpixel of a third color, the third pixel having a subpixel of the second color and a subpixel of the third color, the first pixel, the second pixel, and the third pixel are arranged periodically in the third direction, two of the first pixel, the second pixel, and the third pixel are arranged alternately in the fourth direction, and subpixels of different colors are arranged adjacent to each other in the row and column directions.

4. The display device according to claim 1, wherein $\alpha$ is a multiple of 2.

5. The display device according to claim 4, wherein each of the pixels includes two subpixels arranged in the third direction, the pixels include a first pixel, a second pixel, and a third pixel, the first pixel having a subpixel of a first color and a subpixel of a second color, the second pixel having a subpixel of the first color and a subpixel of a third color, and the third pixel having a subpixel of the second color and a subpixel of the third color, the first pixel, the second pixel, and the third pixel are arranged periodically in the third direction, and two of the first pixel, the second pixel, and the third pixel are arranged periodically in the fourth direction with the remaining one pixel therebetween.

6. The display device according to claim 1, wherein the number of the first subpixels that are consecutive and the number of the second subpixels that are consecutive when counted from one end side in the fourth direction within one cycle are equal to each other.

7. The display device according to claim 6, wherein the number of the consecutive first subpixels and the number of the consecutive second subpixels are two.

8. The display device according to claim 6, wherein the number of the consecutive first subpixels and the number of the consecutive second subpixels are four.

9. The display device according to claim 1, wherein the display unit includes a liquid crystal panel configured to rotate, in accordance with a potential supplied to an electrode provided on one of two opposing substrates, liquid crystal molecules of a liquid crystal layer provided between the two substrates, the liquid crystal molecules rotate in a plane parallel to the two substrates, the liquid crystal molecules in the first subpixel have an initial orientation along the first direction, and the liquid crystal molecules in the second subpixel have an initial orientation along the second direction.

10. A display device comprising a display unit having a display surface on which a plurality of pixels are arranged in row and column directions, wherein each of the pixels includes a plurality of subpixels having different colors, subpixels included in the pixels include a first subpixel and a second subpixel, the first subpixel including an electrode having an opening with a longitudinal direction along a first direction, the second subpixel including an electrode having an opening with a longitudinal direction along a second direction, the first direction and the second direction are directions along the display surface and different from the row and column directions, the longitudinal directions of the openings of all of the subpixels that are arranged in a third direction are identical, the number of subpixels constituting one color pattern in a fourth direction is $3\alpha$, the number of subpixels in which the first subpixels and the second subpixels arranged in the fourth direction constitute one cycle is $6\alpha$, the third direction is one of the row and column directions, and the fourth direction is the other direction of the row and column directions, the number of the first subpixels, having the first direction, that are consecutive and the number of the second subpixels, having the second direction, that are consecutive when counted from one end side in the fourth direction within the one cycle are $3\beta$, and $\alpha$ and $\beta$ are natural numbers.

11. The display device according to claim 10, wherein each of the pixels includes two subpixels arranged in the third direction, the pixels include a first pixel, a second pixel, and a third pixel, the first pixel having a subpixel of a first color and a subpixel of a second color, the second pixel having a subpixel of the first color and a subpixel of a third color, the third pixel having a subpixel of the second color and a subpixel of the third color, the first pixel, the second pixel, and the third pixel are arranged periodically in the row and column directions, and subpixels of different colors are arranged adjacent to each other in the row and column directions.

12. The display device according to claim 10, wherein each of the pixels includes two subpixels arranged in the third direction, the pixels include a first pixel, a second pixel, and a third pixel, the first pixel having a subpixel of a first color and a subpixel of a second color, the second pixel having a subpixel of the first color and a subpixel of a third color, the third pixel having a subpixel of the second color and a subpixel of the third color, the first pixel, the second pixel, and the third pixel are arranged periodically in the third direction, two subpixels of one of two colors among the first color, the second color, and the third color are arranged consecutively in the fourth direction, and two subpixels of the other of the two colors are arranged consecutively in the fourth direction.

13. The display device according to claim 10, wherein the display unit includes a liquid crystal panel configured to rotate, in accordance with a potential supplied to an electrode provided on one of two opposing substrates, liquid crystal molecules of a liquid crystal layer provided between the two substrates, the liquid crystal molecules rotate in a plane parallel to the two substrates, the liquid crystal molecules in the first subpixel have an initial orientation along the first direction, and the liquid crystal molecules in the second subpixel have an initial orientation along the second direction.

14. A display device comprising a display unit having a display surface on which a plurality of pixels are arranged in row and column directions, wherein each of the pixels includes a plurality of subpixels having different colors, subpixels included in the pixels include a first subpixel and a second subpixel, the first subpixel including an electrode having an opening with a longitudinal direction along a first direction, the second subpixel including an electrode having an opening with a longitudinal direction along a second direction, the first direction and the second direction are directions along the display surface and are different from the row and column directions, the longitudinal directions of the openings of all of the subpixels that are arranged in a third direction are identical, the number of subpixels constituting one color pattern in a fourth direction is $2\alpha$, the number of subpixels in which the first subpixels and the second subpixels arranged in the fourth direction constitute one cycle is $4\alpha$, the third direction is one of the row and column directions, and the fourth direction is the other direction of the row and column directions, the number of the first subpixels with odd numbers, the number of the first subpixels with even numbers, the number of the second subpixels with odd numbers, and the number of the second subpixels with even numbers when counted from one end side in the fourth direction within the one cycle are equal to one another, $\alpha$ is a natural number, the subpixels included in the pixels have a subpixel of a first color and a subpixel of a second color, and a subpixel of a third color, the subpixels that are arranged in the fourth direction include at least two of the subpixels that have an identical color, among the at least two subpixels that have the identical color, the longitudinal direction of the opening of an N-th subpixel when counted from one end side in the fourth direction is different from the longitudinal direction of the opening of an (N+1)-th subpixel when counted from the one end side in the fourth direction, and N is a natural number.

15. The display device according to claim 14, wherein the first color is red, the second color is green, and the third color is blue.

* * * * *